US005775695A

United States Patent [19]

Byers

[11] Patent Number: 5,775,695

[45] Date of Patent: Jul. 7, 1998

[54] DEVICE FOR PROVIDING ASTROLOGICAL ENTERTAINMENT AND METHOD THEREOF

[75] Inventor: Stephen T. Byers, 335 Monroe St., Honeoye Falls, N.Y. 14472

[73] Assignee: Stephen T. Byers, Honeoye Falls, N.Y.

[21] Appl. No.: 528,835

[22] Filed: Sep. 15, 1995

[51] Int. Cl.[6] ..... A63F 1/00

[52] U.S. Cl. ..... 273/161; 434/106

[58] Field of Search ..... 273/161, 433, 273/85 G, DIG. 28; 434/106, 236; 463/1

[56] References Cited

U.S. PATENT DOCUMENTS

| | | | |
|---|---|---|---|
| 3,992,787 | 11/1976 | Lynch | 434/106 |
| 4,711,632 | 12/1987 | Detrick | 434/106 |
| 5,516,289 | 5/1996 | Quigley et al. | 434/106 |

OTHER PUBLICATIONS

J. S. & A Catalog, p. 50, An Advertisement for the Astrozodiac Computer.

*Primary Examiner*—Jessica Harrison

*Assistant Examiner*—Michael O'Neill

[57] ABSTRACT

There is provided an entertainment method of evaluating a degree of astrological attractiveness between a requesting player and one of a plurality of subject players. In one aspect of the preferred embodiment, the method includes storing sets of information corresponding respectively with astrological profiles of the plurality of subject players, and providing a set of information corresponding to an astrological profile of the requesting player. In operation, the set of information corresponding with the requesting player is compared to one of the sets of information of the plurality of subject players for determining the degree of astrological attractiveness between the requesting player and the one of the subject players. If the degree of astrological compatability between the requesting player and the one of the subject players exceeds a preselected threshold, personal information about the one of the subject players is provided to the requesting player.

12 Claims, 7 Drawing Sheets

DEVICE FOR PROVIDING ASTROLOGICAL ENTERTAINMENT AND METHOD THEREOF

BACKGROUND OF THE INVENTION

1. Field of the Invention

The present invention relates generally to an astrological entertainment technique and more particularly to a device and method for evaluating either a degree of astrological attractiveness between a requesting player and one of a plurality of subject players or a degree of astrological compatibility between a first player and a second player.

2. Description of Related Art

In a modern, active society, in which extended families are the exception, rather than the rule, it is difficult for a person to meet, and become familiar with others of compatible personality type. In essence, the mechanisms for meeting others of compatible personality type are insufficient. Moreover, even when two people start interacting on a relatively regular basis, it is often difficult for the two persons to determine if they are well suited for one another. One proposed way of bringing couples together, for purposes of "dating" and, at the same time, assessing their degree of compatibility and/or attractiveness to one another, is often accomplished by way of a service that matches personality types. This sort of matching service can be achieved in one of a variety of ways.

In one common instance, a person ("requestor") visits a "dating service" and fills out a sheet, manually, to indicate the desired traits in a prospective mate ("match person"). In response to filling out the sheet, the service provides the requestor with a list of one or more persons who have one or more traits matching the traits indicated by the person (i.e. a list of prospective match persons). To assess which person would be a suitable mate, the requestor designates one or more names of the list and is provided with selected information regarding that person. Such information may vary from a photograph, accompanied by selected data regarding the match person(s), to a video for obtaining a dynamic demonstration of the match person(s).

There are, of course various problems with the above-described approach. In a first case, a requestor may not be competent to assess his/her own traits. Accordingly, the requestor may end up being matched with a person who is quite different, in personality, than himself/herself. In a second case, the terms used by the requestor, to describe himself or herself, may be quite ambiguous. As should be appreciated words can be subjective, and the requester may not be able to describe himself/herself adequately. Accordingly, the same problem that may arise in the first-mentioned case may arise in this second-mentioned case. In many instances, the approach of the dating service may not be any better than the conventional technique of random choice.

In a variation of the above-described approach, a requestor fills out a questionnaire which provides, based on certain selected criteria, an indication of the requestor's personality. To obtain such indication an analysis is employed, the analysis being performed manually or automatically by, for example, a computer. As is known, the sophistication of the questionnaire, and the accuracy of the resulting analysis, can vary widely. In one instance the entire process yields crude, if not silly, results because the criteria employed and/or the analysis applied is deficient.

One criteria that has proven efficacious in assessing compatibility of personality types and/or matching couples, for purposes of dating, employs astrological parameters. Using astrological parameters for this purpose is well accepted, on a widespread basis, in such places as India and China. In one known technique of using astrological parameters, a couple provides personal data (e.g. date of birth, time of birth and place of birth) to one who is familiar with applying astrological parameters to matters of the heart (i.e. an astrological consultant). In a more sophisticated approach, software is employed, by the astrological consultant, to provide the couple with a score indicating the compatibility of the couple. In some instances, the astrological consultant may even provide the couple with advice.

An example of software suitable for providing a couple with the type of results indicated above includes an application known as "Friends and Lovers" developed by Matrix Software. As will be appreciated by those skilled in the art, the Friends and Lovers application may be used to match the astrological attributes of a requestor with the astrological attributes of a selected one of a plurality of persons.

For private use, the Friends and Lovers application is well suited for bringing persons together and assessing their compatibility and/or attractiveness; however the availability of such application is limited because, for those who do not have access to such software, their is no computer based service that a user can access readily by way of a communications channel or network. Essentially, the lack of network sophistication, in the use of any of the above-described techniques, limits their availability on a widespread basis. Additionally, the security of a consulting approach employing Friends and Lovers, or any of the above-mentioned techniques, is typically flawed. More particularly, persons consulting a dating service would rather interact with a computer, where their identity is maintained in selective confidence, rather than with a human consultant who knows that the persons are seeking companionship actively. It would be desirable to provide a computerized astrological consulting service, for assessing compatibility between a couple and/or matching persons, that is readily accessible, on a widespread basis, and possesses a high degree of security for its users.

The present invention employs network capability to achieve various advantageous ends. The following discussion is intended to provide a background for any appropriate network implementation required by the disclosed embodiment below:

Examples of some recent patents relating to network environments of plural remote terminal shared users of networked printers include Xerox Corporation U.S. Pat. Nos. 5,243,518, 5,226,112, 5,170,340 and 5,287,194. Some patents on this subject by others include U.S. Pat. Nos. 5,113,355, 5,113,494 (originally filed Feb. 27, 1987), 5,181,162, 5,220,674, 5,247,670; 4,953,080 and 4,821,107. Further by way of background, some of the following Xerox Corporation U.S. patents also include examples of networked systems with printers: U.S. Pat. Nos. 5,153,577; 5,113,517; 5,072,412; 5,065,347; 5,008,853; 4,947,345; 4,939,507; 4,937,036; 4,920,481; 4,914,586; 4,899,136; 4,453,128; 4,063,220; 4,099,024; 3,958,088; 3,920,895; and 3,597,071. Also noted are IBM Corp. U.S. Pat. Nos. 4,651,278 and 4,623,244, and Canon U.S. Pat. No. 4,760,458 and Jap. Pub. No.59-63872 published Nov. 4, 1984. Some of these various above patents also disclose multi-functional or integral machines [digital scanner/faximile/printer/copiers] and their controls.

Some other network system related publications include "Xerox Office Systems Technology" "..Xerox 8000 Series Products: Workstations, Services, Ethernet, and Software Development" ©1982, 1984 by Xerox Corporation, OSD-R8203A, Ed. T. Linden and E. Harslem, with a "Table of Contents" citing its numerous prior publications sources, and an Abstract noting the April 1981 announcement of "the 8110 Star Informations System, A New Personal Computer.."; "Xerox System Integration Standard Printing Protocol XSIS 118404", April 1984; "Xerox Integrated Production Publishers Solutions:.." Booklet No. "610P50807" "11/85"; "Printing Protocol-Xerox System Integration Standard" ©1990 by Xerox Corporation, XNSS 119005 May 1990; "Xerox Network Systems Architecture", "General Information Manual", XNSG 068504 April 1985, with an extensive annotated bibliography, ©1985 by Xerox® Corporation; "Interpress: The Source Book", Simon & Schuster, Inc., New York, N.Y., 1988, by Harrington, S. J. and Buckley, R. R.; Adobe Systems Incorporated "PostScript® Language Reference Manual", Addison-Wesley Co., 1990; "Mastering Novell® Netware®", 1990, SYBEX, Inc., Alameda, Calif., by Cheryl E. Currid and Craig A. Gillett; "Palladium Print System" ©MIT 1984, et sec; "Athena85" "Computing in Higher Education: The Athena Experience", E. Balkovich, et al, Communications of the ACM, 28(11) pp. 1214–1224, November, 1985; and "Apollo87" "The Network Computing Architecture and System: An Environment for Developing Distributed Applications", T. H. Dineen, et al, Usenix Conference Proceedings, June 1987.

Noted regarding commercial network systems with printers and software therefor is the 1992 Xerox® Corporation "Network Publisher" version of the 1990 "DocuTech®" publishing system, including the "Network Server" to customer's Novell® 3.11 networks, supporting various different network protocols and "Ethernet"; and the Interpress Electronic Printing Standard, Version 3.0, Xerox System Integration Standard XNSS 048601 (January 1986). Also, the much earlier Xerox® Corporation "9700 Electronic printing System"; the "VP Local Laser Printing" software application package, which, together with the Xerox® "4045" or other Laser Copier/Printer, the "6085" "Professional Computer System" using Xerox Corporation "ViewPoint" or "GlobalView®" software and a "local printer [print service] Option" kit, comprises the "Documenter" system. The even earlier Xerox® Corporation "8000" "Xerox Network Services Product Descriptions" further describe other earlier Xerox® Corporation electronic document printing systems. Eastman Kodak "LionHeart™" systems, first announced Sep. 13, 1990, are also noted. Current popular commercial published "systems software" including LAN workstation connections includes Novell® DOS 7.0, "Windows™" NT 3.1, and IBM OS/2 Version 2.1.

SUMMARY OF THE INVENTION

In accordance with one aspect of the invention, there is provided an astrological entertainment method of evaluating a degree of astrological attractiveness between a requesting player and one of a plurality of subject players, comprising: a) storing sets of information corresponding respectively with astrological profiles of the plurality of subject players, each of the sets of information including personal information regarding one of the plurality of subject players; b) providing a set of information corresponding to an astrological profile of the requesting player; c) electronically comparing the set of information corresponding with the requesting player to one of the sets of information of the plurality of subject players for determining the degree of astrological attractiveness between the requesting player and the one of the subject players; and d) if the degree of astrological compatability between the requesting player and the one of the subject players exceeds a preselected threshold, transmitting the personal information of the one of the subject players to the requesting player.

In accordance with another aspect of the invention, there is provided an astrological entertainment method of evaluating a degree of astrological compatibility between a first player and a second player, comprising: a) storing a set of information corresponding with an astrological profile of the first player; b) providing a set of information corresponding with an astrological profile of the second player; c) electronically comparing the set of information corresponding with the astrological profile of the first player to the set of information corresponding with the astrological profile of the second player to obtain an astrological compatibility score; d) normalizing the astrological compatibility score on the basis of a reference score, the reference score being based on a score received by two players having an ideal predetermined astrological relationship; and e) transmitting the astrological compatibility score, normalized in accordance with said d), to at least one of the first and second players for providing a reflection of the degree to which the first and players are astrologically compatible.

DETAILED DESCRIPTION OF A PREFERRED EMBODIMENT

1. The System

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1A:
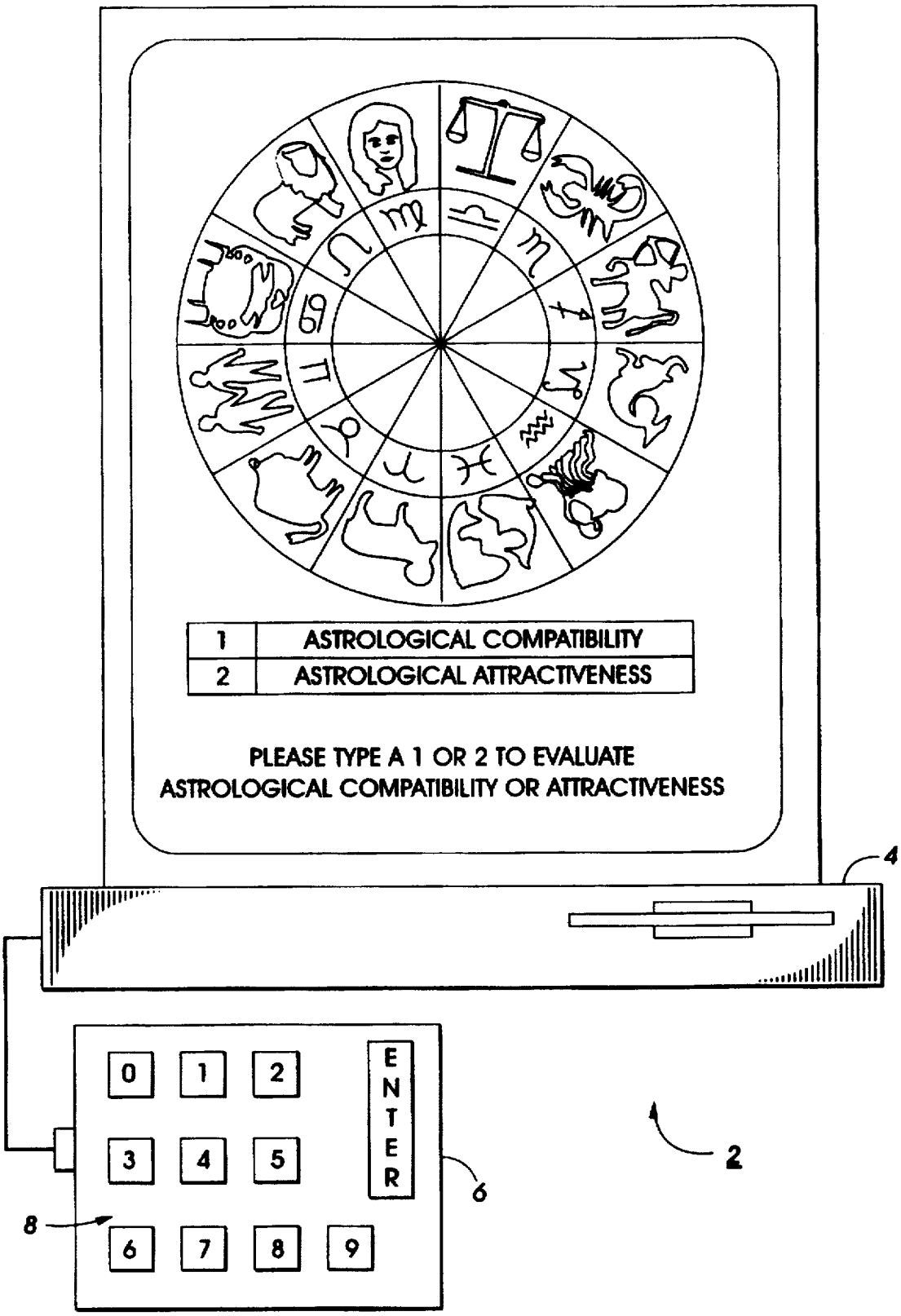
FIG. 1A is a schematic, elevational view of a device for evaluating a degree of astrological attractiveness and/or astrological compatibility between two players.

Referring to FIG. 1A, a simplified astrological entertainment system for evaluating a degree of astrological attractiveness and/or astrological compatibility between two players is designated by the numeral 2. The astrological entertainment system 2 includes a dedicated processing unit 4 interfaced with a suitable input device 6. As will appear, astrological entertainment system 2 further includes a server to facilitate the above-mentioned evaluation. In the illustrated embodiment of FIG. 1A, data input, which would preferably include input of birth data, is achieved with a ten-key pad 8 of input device 6. As discussed below, in the preferred embodiment,.input is achieved with a networked device, such as a telephone, and the unit 4 includes all of the necessary hardware and software required to perform the above-mentioned evaluation.

Figure 1B:
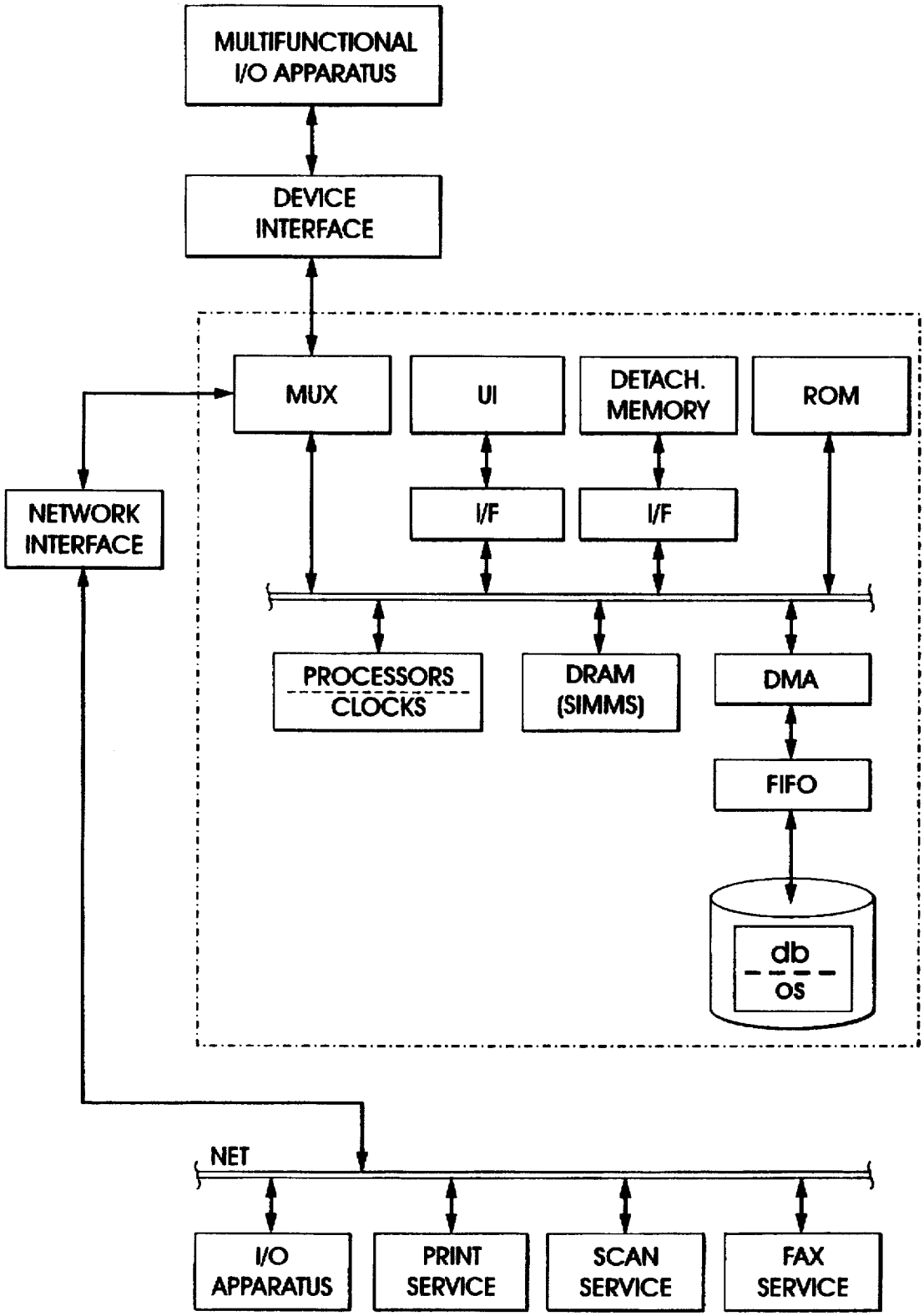
FIG. 1B is a block diagram of an astrological consulting server shown in conjunction with various input/output devices, the astrological consulting server being used to implement the method of the present invention.

To more fully comprehend the implementation of the disclosed, preferred embodiment, reference is made to FIG. 1B. More particularly, as shown in FIG. 1B, an astrological consulting server ("server") is designated by the number 10, the server 10 communicating with various Input/Output ("I/O") components by way of a network ("NET") arrangement 12 and a local device arrangement 14. In one example, the server 10 is a personal computer ("PC"), such as an IBM Compatible PC which employs a DOS operating system, such as MS-DOS. The PC of the server 10 includes various memory, I/O, data transfer and processing components. Each of the various components communicate with one another by way of a conventional 32 bit bus, designated by the numeral 16.

The "heart" of the server resides in a processing arrangement, designated by the numeral 18, which arrangement functions, conjunctively, with one or more clocks, designated by the numeral 19. In the preferred embodiment, the server exploits two processing units: with a first unit comprising a coupled pair of 486 microprocessors and functioning as a single 486 microprocessor with a clock speed of 66 MHz, and with a second unit having a slave coprocessor operating in parallel with the first unit to provide arithmetic capabilities, i.e. "number crunching". As is known by those skilled in the art, the processing arrangement 18 is responsible for control of the various memory, data transfer and I/O components of the server.

The server 10 includes various memory components: First detachable memory 20 (e.g. floppy) is coupled with the bus 16 by way of a suitable interface 22. As is known, the floppy disk can be used to introduce various application programs and/or any necessary data to the server. Second, read only memory ("ROM") 24 is coupled with the bus 16 and, in one example provides control instructions for operation of the server 10. Such control instructions may include, among others, directives for controlling booting up of the server. Third, dynamic random access memory ("DRAM") 26 is employed to store a significant amount of code and data required to enable the operation of consulting routines of the preferred embodiment. The DRAM employs several banks of SIMMs to achieve a preferred memory capacity of 16 MB. Finally, a hard disk drive device ("Disk") 28, employing multiple platters and multiple read/write heads, is coupled with the bus 16, in one example, with a buffer (FIFO) 30 and direct memory access ("DMA") 32. As is known, the DMA allows movement of data, throughout the server, without constant intervention of the processor 18. As will be discussed in further detail below, the disk 28 is responsible for maintaining the operating system and a database. It will be appreciated that in the preferred system, the disk exploits SCSI control.

Local interaction with the server 10 is accomplished by means of a user interface ("UI") 34, which may include, among other components, a keyboard and a CRT. Through use of the UI, a server operator is able to transmit commands to and receive information from the various components of the server. The UI 34 is coupled with the bus 16 by way of a suitable interface 36. As discussed in further detail below, the server employs software manufactured by MicroSoft® Corp. under the trademark of Windows® 3.1. To facilitate the use of such software, the UI includes a cursor system which preferably includes a mouse and corresponding pad.

While the server 10 is shown as including a specified suite of memory, I/O, data transfer and processing components, it will be appreciated that various circuit boards could be added to the server to enhance functional capability without affecting the concept upon which the disclosed embodiment is based. For example, the memory capability of the server 10 could be enhanced by the addition of a CD-ROM device. Moreover, voice recognizing hardware/software could be added to receive data via a telephone, the telephone, as discussed in further detail below, being associated with the network arrangement 12 or the device arrangement 14.

The server 10 is coupled with the network arrangement 12 and the local device arrangement 14 by way of a network interface 40 and a device interface 42. In one example the server communicates selectively with the arrangements 12, 14 by way of a suitable multiplexing arrangement 44. The network interface 40 includes all of the hardware and software necessary to relate the hardware/software components of the server 10 with the hardware/software components of the network arrangement 12. For instance, to interface various protocols between the server and the network arrangement, the network interface could be provided with Netware® from Novell® Corp. Additionally, to facilitate communication from both telecommunications and Facsimile ("FAX") sources, the network interface is preferably provided with dedicated hardware from New Voice Inc., designated by the serial number "NV800". The NV800, which includes a dedicated processor, serving to implement a modem capability, is a multiplexing type device, i.e. a PBX adapted device, for facilitating the linking of multiple (e.g. 8) FAX/voice based lines to the server 10. More particularly, the NV800 permits multiple users to access and use the server 10 in a multiplexed fashion. As discussed in further detail below, the New Voice system is used in conjunction with dedicated software referred to as "DAX" and manufactured by Ram Research.

In the network arrangement 12, various I/O and storage devices are interconnected with a bus 46. In particular, the devices include, among others the following: I/O Apparatus 48, Print Service 50, Scan Service 52 and FAX server 54. In the present example the I/O Apparatus 48 includes a telephone and/or a workstation, such as any suitable PC compatible apparatus. In this example, the telephone is digitally based so that no interface, such as a modem is required; however, in other examples the telephone would employ a suitable telecommunications interface without affecting the operation of the currently disclosed embodiment. Additionally, the Print Service 50 includes any suitable print service manufactured by Xerox Corporation, such as the "9700 Print Service". As is known, the 9700 Print Service includes a processor, storage section and 9700 printer which, in conjunction, permit both printing and storage to be performed remotely of the server 10. In particular, files from the server 10 can be archived at the Print Service 50. Additionally, the Scan Service preferably includes a workstation and a scanner, provided in the form of a package. This sort of package is made available by Xerox Corporation in the form of a WG40 scanner coupled with a 6085 workstation. It will be appreciated that the Scan Service is preferably provided with Optical Character Recognition ("OCR") capability so that the user of the server 10 can scan hard-copy, including personal data, to the Scan Service for use by the server 10. Finally, the FAX Service 54 assumes the form of any suitable networked FAX device, such as the LAN FAX Service manufactured by Xerox Corporation under the 7032 series.

In the local device arrangement 14, I/O and storage devices are preferably interfaced with the server 10 by way of a suitable device interface 42. As will be appreciated by those skilled in the art, the hardware/software suite of the local device interface will vary according to the devices employed and the necessary hardware/software components required to implement the device interface will vary according the specifications of the devices employed. The various I/O devices of the arrangement 14 can be provided separately or, as shown in the illustrated embodiment of FIG. 1B, in the form of a single multi-functional apparatus 55, such as a multi-functional digital copier manufactured by Canon Corp., in the form of a LAN capable GP55, or a 3010 multi-functional digital copier manufactured by Fuji-Xerox Corp. In any event, the local devices preferably include, as a minimum, a telephone, a scanner, a printer and a FAX device. As with the Scan Service discussed above, the scanner is provided with OCR capability so that personal data can be read from hardcopy for use by the server 10.

2. Method of Operation a. System Software

Figure 2:
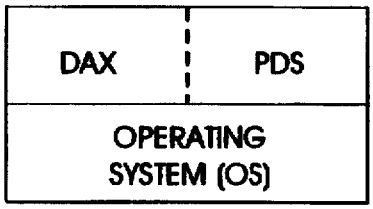
FIG. 2 is a schematic view of a software configuration used in the astrological consulting server of the present invention.

Referring to FIG. 2, the major software components employed in the disclosed embodiment are designated in schematic form. A facility, including DAX software (mentioned above), which, in conjunction with NV800 hardware, permits connection of multiple lines with the server 10, and "Professional Development System" ("PDS") software manufactured by MicroSoft®, Inc., "floats" on an operating system, such as MS-DOS. These major software components are distributed across both volatile and non-volatile memory in the server 10. The above-mentioned software is used to implement a method which can be performed in one of a first mode and a second mode. In the first mode of operation, the method is directed toward a technique for obtaining an astrological match between a requestor (caller) and a selected one of a plurality of persons whose respective astrological profiles (respective sets of astrological data) are stored in a database (FIG. 1B). In the second mode of operation, the method is directed toward a technique for assessing a degree of astrological compatibility and/or attractiveness between a first person x(1) and a second person x(2).

b. First Mode of Operation

Figure 3:
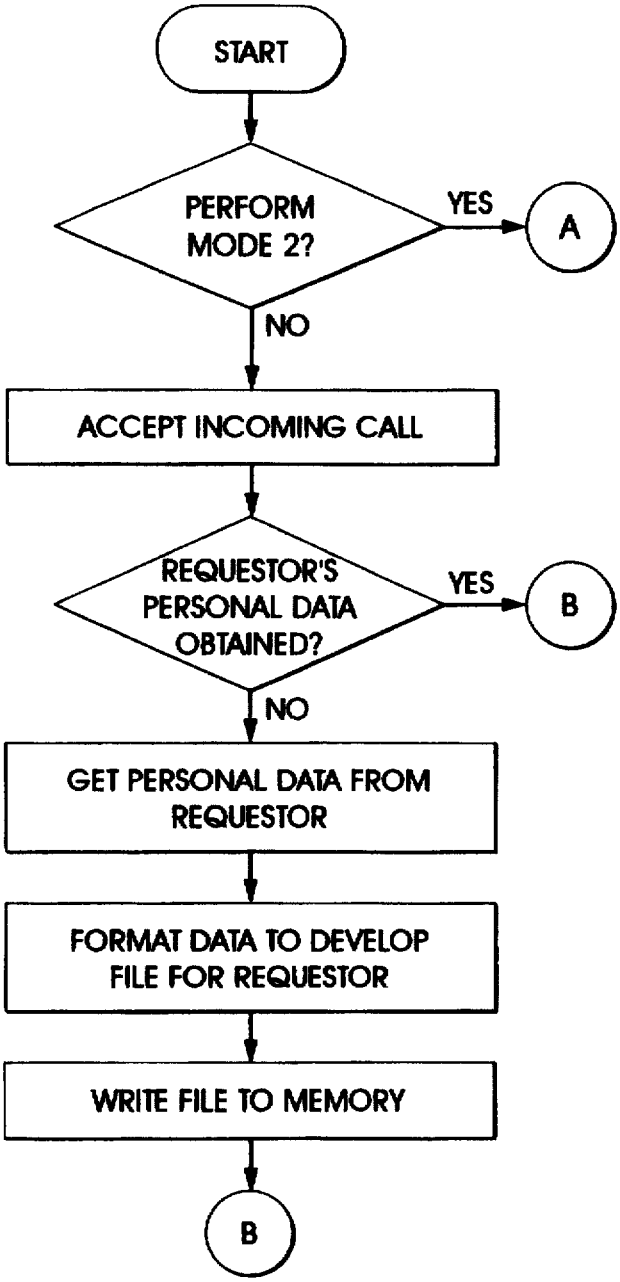
FIGS. 3 is a flow chart of a routine used to develop a file for use in assessing an astrological match between two persons.
Figure 4:
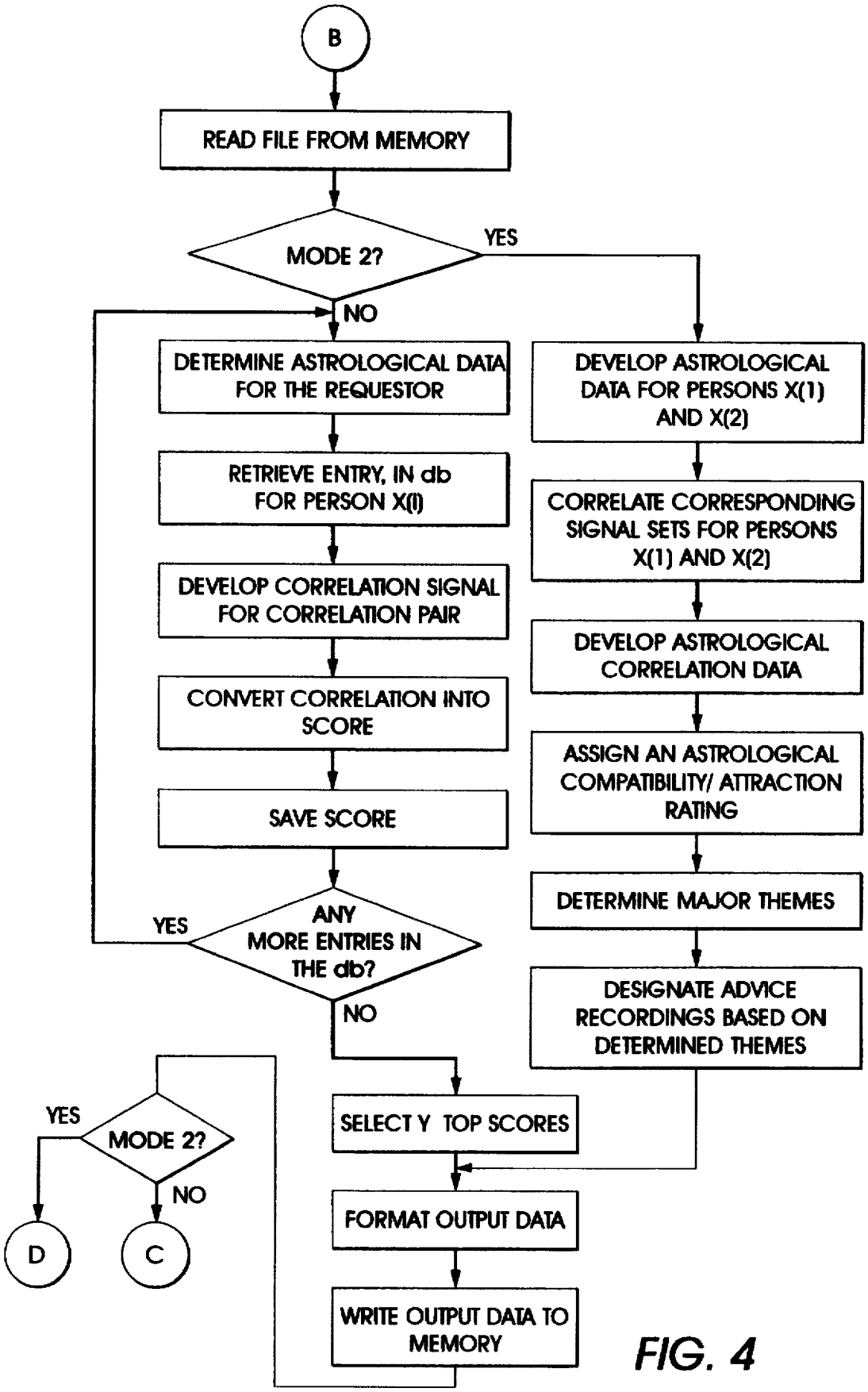
FIG. 4 is a flow chart of a routine used to 1) obtain an astrological match between a requestor and a selected person in a database, and 2) assess the degree of astrological compatibility and/or attractiveness between two persons.
Figure 5:
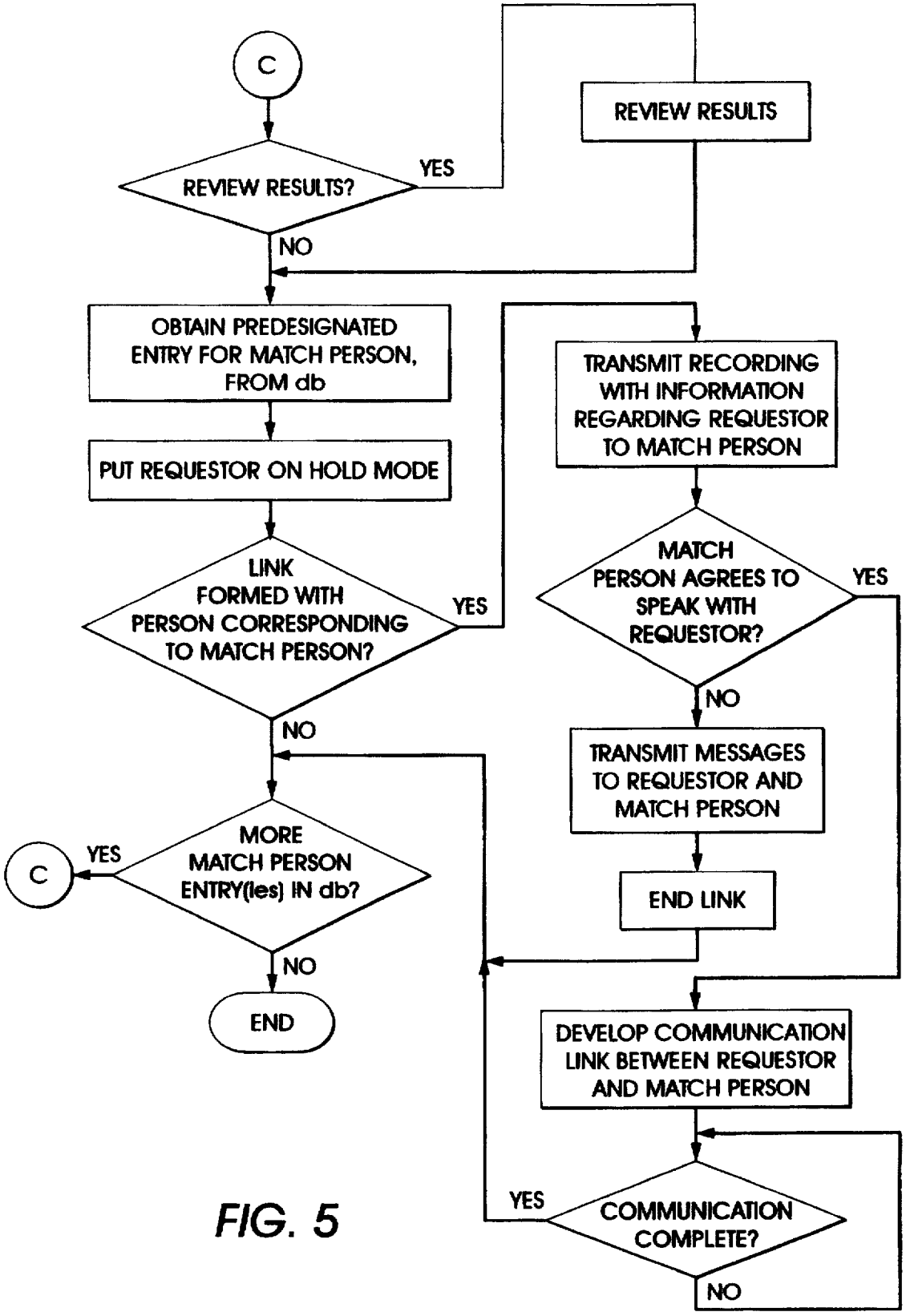
FIG. 5 is a flow chart of a routine used to facilitate the transmission of a set of results obtained through employment of the routine of FIG. 4.

Referring generally to FIGS. 3–5, a discussion of the first mode of operation is provided. In particular, at step 60 (FIG. 3), it is decided whether input to the server 10, which may have its source in, among others, a telephone, a FAX apparatus or a scanner with OCR, is intended to be processed in mode 1 or mode 2. Step 60 can be implemented through use of DAX which queries the caller or requestor, to obtain information over the network. While it will be understood that the input can emanate from a wide variety of sources, in the following discussion of both the first mode of operation and the second mode of operation, it will be assumed that the input is from a telephone. This does not imply that the disclosed method is not equally appropriate for use with input other than voice-related input.

Assuming that the requestor intends to use the first mode, the incoming call is received at step 62 and DAX is employed, at step 64, if necessary, to obtain selected astrological related data ("PersonalData"), such as age, sex, sexual preference, date of birth, time of birth and place of birth, of the requestor—the data relating to date of birth, time of birth and place of birth will hereinafter be related to as "birth-related data". If the PersonalData for the requester has been obtained previously, then the process proceeds to a routine (FIG. 4) which, among other functions, obtains an astrological match between the requester and a selected one of a plurality of persons whose respective astrological profiles are stored in a database (FIG. 1B). As will be appreciated by those skilled in the art, PersonalData can be obtained and stored for later use with software similar to that used by Mead Data Corp. in their Lexis®/Nexis® database software.

If the PersonalData for the requestor has not been obtained, then step 66 is initiated. Most of PersonalData, except for data related to place of birth, can be obtained readily through use of keys on the telephone. It has been found that a preferred approach for obtaining place of birth is to direct the requestor to enter the zip code or telephone area code corresponding to his/her place of birth. In response to obtaining PersonalData from the requestor, the data is formatted (step 68) with a reference, such as a pointer. That is, the PersonalData for the requester is placed in a file, such as an ASCII file, with the pointer, and, via step 70, stored out to memory. The pointer is used to indicate the beginning of the file and an indication, designating the length of the file, is also provided.

Referring to FIG. 4, to obtain the above-mentioned match, the formatted file is read from memory (step 74) and since the operation is in the first mode, the process proceeds through step 76 to step 78 where the PersonalData of the requestor is processed with predeveloped astronomic-based formulae ("formulae") It should be noted that each formatted includes an indication (e.g. toggled bit) providing the system with knowledge regarding which mode of operation is being employed. The formulae employ a conceptual framework based on, among other concepts, 1) the ecliptic position of the sun, moon, mercury, venus, mars, jupiter, saturn uranus, ascendant midheaven and north node, and 2) the right ascension of sun, moon, mercury, venus, mars, jupiter, saturn uranus, ascendant midheaven and north node. Further details regarding the manner in which suitable formulae are developed is discussed in the following references, the pertinent portions of which are incorporated herein by reference:

Sargent, L.

"How to Handle Your Human Relations"

American Federation of Astrologers 1970 (2d ed.)

Meeus, J.

"Astronomical Formulae for Calculators"

Willmann-Bell, Inc.

1988 (4th ed.)

Hand, R.

"Planets in Composite"

Para-Research, Inc.

1975

Holden, R.

"The Elements of House Division"

Fowler & Co., Ltd.

1977

After developing a set of astrological data for the requester, an entry (X(i)), including astrological data for a given person X(i), whose pertinent astrological data has been developed and stored previously, is obtained. A signal, indicating the correlatibility of the two sets of data, is preferably developed through use of a selected correlation function of the type used to correlate electronic signals. In the preferred embodiment, the selected correlation function is derived empirically and implemented logically in the server 10. For ease of data handling, the correlation signal is converted into a score (step 84) and stored in memory. Through use of the above-described correlation technique and decision step 88, the astrological data of the requester is correlated individually with each entry in the database.

In the preferred embodiment, the above-mentioned correlation is achieved with a set of formulae, which formulae are shown, as code, in an attached appendix. The formulae employ multiple indicators, the indicators being considered in determining a relationship between a set of significant points in a first chart and a set of significant set of points in a second chart. In one example each chart includes up to 40 points. Referring specifically to the attached code, an empirical approach is used to evaluate both astrological attractiveness (pp. 1–6) and astrological compatibility (pp. 6–18).

As will be recognized by those skilled in the art, the formulae are iterative and thus accomodate for the influence of each indicator. That is, the formulae are sensitive to variations resulting from each indicator. Essentially, the formulae permit not only consideration of all of the indicators as a whole, but the effect of various subsets of indicators on a resulting score. This permits dynamic weighting for the correlation process. As will be further recognized, the formulae are provided with several coefficients which allow for implemention of and adjustment in the dynamic weighting.

A selected number of the top scores (i.e. Y scores) are then selected (step 90) and those scores are formatted, via step 92, into a file as output data. In the preferred embodiment, recordings of various persons, whose astrological data is maintained in the database, are maintained in the disk 28 of FIG. 1B. Additionally, pointers are provided in the formatted file to correspond the Y scores their respective recordings. Accordingly, one or more of these recordings can be played for the requester. At step 94, the output data of the formatted file is written to memory and, at step 96, since the operation is in the first mode, the process continues to step 100(FIG. 5).

Referring to FIG. 5, at step 100, the requestor is provided an opportunity to review the results by listening to one or more recordings stored in disk. The recording(s) is played back over the telephone, to the requestor, through aid of the NV800 board and the DAX software. If the requestor wishes to review one or more of the recordings, then the process proceeds to step 102, otherwise, at step 104, an entry, designated by the requestor, is retrieved from the database. As programmed, with DAX, the requester is then put on hold (step 106), and the person corresponding to the entry ("match person") is then called. If the match person is not available (steps 108 and 110) then the process loops back to step 100, provided more match entries are available in the database. Assuming the match person is available, then a recording of the requestor, developed from the PersonalData provided by the requestor, is played, at step 112, for the "match person" on the other side of the line.

As should be appreciated, placing the requestor on hold and querying the match person, in private, protects the privacy of the match person. Consequently, as should be apparent from step 114, if the match person feels uncomfortable about speaking with the requestor, for any reason, then a conversation between the requester and the match person need never take place. One of the purposes of the first mode technique is to match couples, and if a person of the database refuses to speak with a prospective requestor then he/she is informed, via step 116, that persistent refusal to participate will not be accepted. Additionally, at step 116, the requestor is told that the match person does not wish to speak to him or her. In response to step 116, the link is ended (step 118), by use of DAX, and the process continues at step 110. If the match person indicates that he or she will accept the call (step 114), then a link is developed, via step 120, between the requestor and the person. Once the communication between the requester and the match person is complete (step 122), the process continues at step 110. Once attempts have been made to contact all of the match persons (step 110), the first mode of operation ends.

c. Second Mode of Operation

Figure 6:
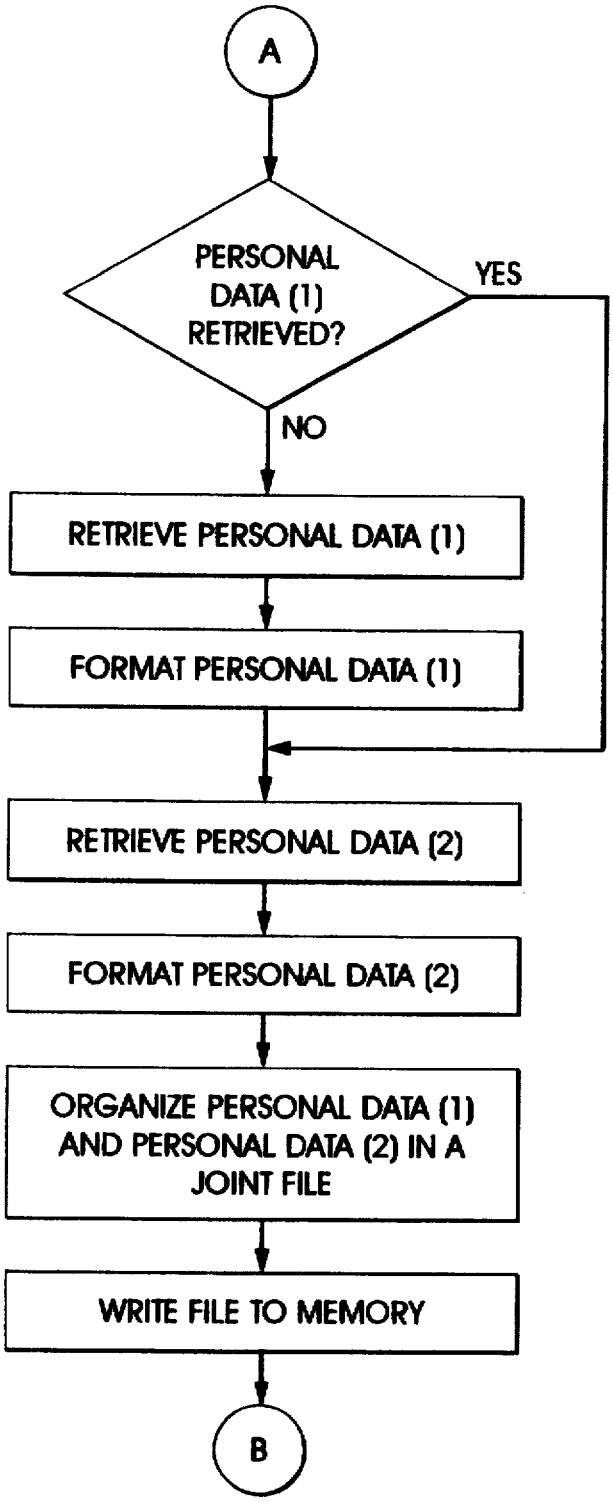
FIG. 6 is a flow chart of a routine used to develop a file for assessing a degree of astrological compatibility and/or attractiveness between two persons.
Figure 7:
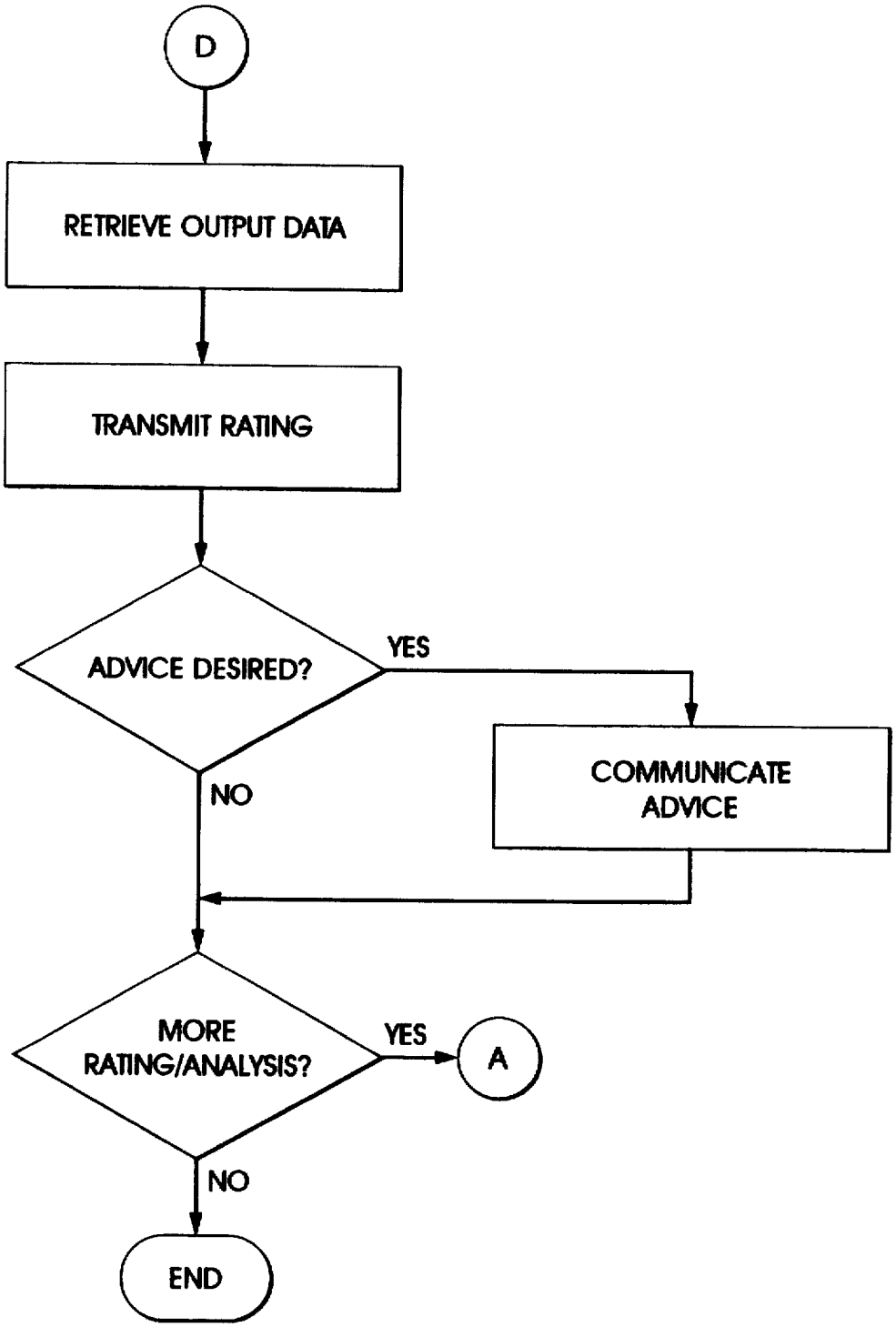
FIG. 7 is a flow chart of a routine used to facilitate the transmission of a set of results obtained through employment of the routine of FIG. 4.

Referring generally to FIGS. 4, 6 and 7, the second mode of operation is discussed in detail. In particular, it is determined, at step 126, whether PersonalData(1) corresponding with an incoming caller (i.e. a person x(1)) has already been retrieved from memory. It should be recognized that the PersonalData(1) may have already been entered into the database (FIG. 1B). The type of data contemplated for PersonalData(1) (and PersonalData(2)) is the same as that contemplated for the PersonalData of the first mode of operation. If PersonalData(1) has already been retrieved, then the process proceeds to step 132, otherwise the PersonalData(1) is retrieved, through use of the telephone, NV800 board and DAX software (step 128) and placed in a form (step 130) similar to that discussed above for the first mode of operation. After the PersonalData(1) has been collected, the PersonalData(2) for person x(2) is retrieved (step 132) and placed in a form (step 134) similar to that of PersonalData(2). Referring to step 136, once the files for PersonalData(1) and PersonalData(2) are compiled, a joint file, being written in ASCII and having an appropriate pointer and file size indication, is developed. This joint file is then, via step 138, written to memory and the process proceeds to step 74 and 76, of FIG. 4, where the joint file is read from memory and the process is directed to step 142.

At step 142, astrological data is developed for person x(1) and person x(2) by processing the birth-related data of PersonalData(1) and PersonalData(2) with the above-mentioned astronomically-based formulae. The signal sets corresponding to the respective astrological data are then, at step 144, correlated with the above-mentioned, empirically formulated correlation function. Based on the correlation of step 144, astrological correlation data is developed at step 146. Preferably, the astrological correlation data includes an absolute score which will vary in accordance with the compatibility and/or attractiveness between person x(1) and person x(2). In practice, that score is divided by an idealized/reference score (step 148) to obtain a normalized compatibility/attraction rating ("rating"). It will be appreciated that the idealized/reference score corresponds with that obtained by a couple which is particularly well suited for one another, in an astrological sense.

At step 150, "major themes", pertinent to the perceived astrological relationship of person x(1) and person x(2) is determined by reference to the astrological correlation data. To understand the manner in which such themes are developed, further discussion, regarding the correlation technique, is required. Preferably, the correlatibility of the set of astrological data for the first person and the set of astrological data for the second person is the sum of a plurality of subcorrelations, with each subcorrelation corresponding to the degree to which a selected data type of the set of astrological data for the first person (e.g. sun sextile sun) correlates to the comparable data type of the set of astrological data for the second person. Each subcorrelation has a weighted score, the weighted score pertaining specifically to the correlatibility for a particular data type. To obtain major themes, a selected number of the highest weighted scores are selected and the themes that pertain to the corresponding data types are noted. In practice, a large variety of advice recordings, relating to each of the data types is stored in disk. In step 152, the recordings for the noted data types are designated and, at step 92, the file is formatted by mapping the rating to the advice recordings. The formatted file is then written to memory as output data (step 94) and, via step 96, the process proceeds to the illustrated technique of FIG. 7.

At step 156, of FIG. 7, the output data is retrieved from memory (step 156) and the rating is transmitted (step 158) to an incoming caller (e.g. person x(1)). It is then determined, at step 160, whether the caller desires to hear the advice recordings. If he/she so desires, the recordings are played with DAX, from disk (step 162), otherwise the system ascertains, at step 164, whether any further rating/analysis is desired by the incoming caller. The step 164 either directs the caller to the beginning of second mode operation (FIG. 6) or ends any further communication.

Numerous features of the above-disclosed embodiment will be appreciated by those skilled in the art: One feature of the disclosed embodiment is that it provides a wide range of astrological services in a single package. In one instance, pertinent data is gathered efficiently by way of several types of input devices. In another instance, two elaborate astrologically-based consulting services are made available for "rating" a relationship or matching a couple. The power and capability of the astrological consulting server, with its attendant hardware and software, permits the multiple elaborate services to be offered in the single package. In yet another instance, results from either consulting service can be transmitted readily from the server to one or more persons.

Another feature of the disclosed embodiment is that it provides an improved technique of astrological evaluation. More particularly, a full range of astronomical parameters are employed in each of the rating/matching services so that relatively accurate results are obtained.

Yet another feature of the disclosed embodiment is that it can be made available to a large group of users over an extensive geographical region. In particular, through use of multiple inputs, many people can access the server at one time. Moreover, with a PBX adapted arrangement, the many users can access the server in a multiplexed fashion. Finally, since the server is coupled with a network, people from all over the world can call in to the server and avail themselves of the rating/matching services.

Yet another feature of the disclosed embodiment is that it permits information to be transmitted to the users on multiple levels. In one example, a user can obtain results through one of a plurality of I/O devices and, in another example, the results can be stored, at a location remote from the server, for retrieval at a later time. It is particularly advantageous that a full range of recordings, including advice based on results, can be stored in mass memory (e.g. disk) for use in providing users with detailed explanations, if desired, regarding their results.

Another feature of the disclosed embodiment is that users of the matching service can be assured that their privacy will be maintained at all times. That is a matched couple will communicate with one another only when a selected condition is met. Preferably, such selected condition constitutes an approval by both parties, of the couple, to such communication.

Part #5

APPENDIX

```
FOR i = Begin TO Eind: IF Tryl(i).ChtDel GOTO DoNxt
    TmpSort(-Begin + i + 11).VBoxNum = Tryl(i).VBoxNum:
    IF NOT Gay THEN
     IF MorW = One THEN
      IF ERP(1) > Tryl(i).plt(1) + 2 - 2 * (Tryl(i).plt(1) < 1942)
THEN
       GOTO DoNxt
      ELSEIF ERP(1) + 10 + 2 * (Tryl(i).plt(1) > 1970) <
Tryl(i).plt(1) THEN
       GOTO DoNxt
      END IF
     ELSEIF Tryl(i).plt(1) > ERP(1) + 2 - 2 * (ERP(1) < 1942) THEN
      GOTO DoNxt
     ELSEIF Tryl(i).plt(1) + 10 + 2 * (ERP(1) > 1970) < ERP(1) THEN
      GOTO DoNxt
     END IF
    END IF
    IF ERP(2) < Two THEN
     IF Tryl(i).plt(2) = One OR Tryl(i).plt(2) = Svn OR
Tryl(i).plt(2) = Nul THEN  ELSE GOTO DoNxt
    ELSEIF ERP(2) = Two THEN
     IF Tryl(i).plt(2) = Two OR Tryl(i).plt(2) = Ten THEN  ELSE
GOTO DoNxt
    ELSEIF ERP(2) = Drie THEN
     IF Tryl(i).plt(2) = Drie OR Tryl(i).plt(2) = Four THEN  ELSE
GOTO DoNxt
    ELSEIF ERP(2) = Four THEN
     IF Tryl(i).plt(2) < Drie OR Tryl(i).plt(2) = Fv OR
Tryl(i).plt(2) = Ate OR Tryl(i).plt(2) > Ten GOTO DoNxt
    ELSEIF ERP(2) = Fv THEN
     IF Tryl(i).plt(2) = Ate OR Tryl(i).plt(2) = Ten THEN  ELSE
GOTO DoNxt
    ELSEIF ERP(2) = Six THEN
     IF Tryl(i).plt(2) = Four OR Tryl(i).plt(2) = Elvn THEN  ELSE
```

B1

```
GOTO DoNxt
    ELSEIF ERP(2) = Svn THEN
     IF Tryl(i).plt(2) = One OR Tryl(i).plt(2) = Four OR
    Tryl(i).plt(2) = Svn OR Tryl(i).plt(2) = Ten OR Tryl(i).plt(2) =
    Elvn THEN  ELSE GOTO DoNxt ELSEIF ERP(2) = Ate THEN
     IF Tryl(i).plt(2) = Fv OR Tryl(i).plt(2) = Svn THEN  ELSE GOTO
DoNxt
    ELSEIF ERP(2) = Nin THEN
     IF Tryl(i).plt(2) = Four OR Tryl(i).plt(2) = Twlv THEN  ELSE
GOTO DoNxt
    ELSEIF ERP(2) = Ten THEN
     IF Tryl(i).plt(2) = Two OR Tryl(i).plt(2) = Four OR
    Tryl(i).plt(2) = Svn OR Tryl(i).plt(2) = Ten OR Tryl(i).plt(2) =
    Twlv THEN  ELSE GOTO DoNxt ELSEIF ERP(2) = Elvn THEN
     IF Tryl(i).plt(2) = Six OR Tryl(i).plt(2) = Svn THEN  ELSE
GOTO DoNxt
    ELSE
     IF Tryl(i).plt(2) = Ate OR Tryl(i).plt(2) = Ten THEN  ELSE
GOTO DoNxt
    END IF: Skr = Nul: k = Nul: NegSkr = Nul: IF DefltTym GOTO
DoRA
DoAsc:  AscSn = INT(ERP(8 + k) / 30) + 1: DescSn = AscSn + 6: IF DescSn
> Twlv THEN DescSn = -12 + DescSn
    FOR j = Drie + k TO 6 + k: P2 = Tryl(i).plt(j):
     s = INT(P2 / 30) + 1: IF s = AscSn OR s = DescSn THEN Skr =
Skr + 8
     Ang = ABS(-ERP(8 + k) + P2): IF Ang > One80 THEN Ang = -Ang +
360
     IF Ang < Ate - 4 * (j < Fv + k) THEN
      IF j < Fv + k THEN Skr = (-Ang / 2 + 8) * 10 + Skr ELSE Skr
= (-Ang / 2 + 4) * 10 + Skr
     ELSEIF Ang < One84 - 2 * (j <> Six + k) AND Ang > One76 + 2 *
(j <> Six + k) THEN
      Ang = ABS(-Ang + 180): IF j < Fv + k THEN Skr = (-Ang / 2 +
4) * 10 + Skr ELSE Skr = (-Ang / 2 + 2) * 10 + Skr
     ELSEIF Ang < 125 - (j = Four + k) AND Ang > 115 + (j = Four +
```

B1 cont'

```
k) THEN
        Ang = ABS(-Ang + 120): IF j <> Four + k THEN Skr = (-Ang +
4) * 10 + Skr ELSE Skr = (-Ang + 6) * 10 + Skr
      ELSEIF Ang < Nty3 - (j = Four + k) AND Ang > Aty7 + (j = Four
+ k) THEN
        Ang = ABS(-Ang + 90):
        IF j = Four + k THEN
          NegSkr = (-4 + Ang) * 10 + NegSkr
        ELSEIF j > Fv + k THEN
          Skr = (-Ang + 4) * 10 + Skr
        END IF
      ELSEIF Ang < Sxt2 - (j <> Four + k) AND Ang > Fvt8 + (j <>
Four + k) THEN
        Ang = ABS(-Ang + 60): IF j <> Four + k THEN Skr = (-Ang + 3)
* 10 + Skr ELSE Skr = Skr + 10
      END IF
    NEXT: IF k <> Six THEN k = Six: GOTO DoAsc
    k = Nul:
DoRA:  FOR j = Drie + k TO 7 + k: P2 = Tryl(i).plt(j):
      Ang = ABS(-ERP(3 + k) + P2): IF Ang > One80 THEN Ang = -Ang +
360
      IF Ang < Twlv - 6 * (j = Four + k) + 4 * (j > Fv) THEN
        IF j = Four + k THEN
          Skr = (-Ang + 18) * 10 + Skr
        ELSEIF j = Fv + k THEN
          Skr = (-Ang + 12) * 10 + Skr
        ELSE
          Skr = (-Ang + 8) * 10 + Skr
        END IF
      ELSEIF Ang < One86 - 3 * (j = Four + k) + 3 * (j = Six + k)
AND Ang > One74 + 3 * (j = Four + k) - 3 * (j = Six + k) THEN
        Ang = ABS(-Ang + 180):
        IF j = Four + k THEN
          Skr = (-Ang + 9) * 10 + Skr
        ELSEIF j = Fv + k THEN
          Skr = (-Ang + 6) * 10 + Skr
```

B' cont'

```
      ELSEIF j = Six + k THEN
        Skr = (-Ang + 3) * 10 + Skr
      ELSE
        NegSkr = (-6 + Ang) * 10 + NegSkr
        IF k <> Nul THEN
          IF NegSkr = Nul THEN m = Skr ELSE m = Skr / -NegSkr
          IF m < Fv THEN
            NegSkr = -30 + NegSkr
          ELSEIF m > Twlv THEN
            IF NegSkr < -30 THEN NegSkr = NegSkr + 30 ELSE NegSkr
= Nul
          END IF
        END IF
      END IF
    ELSEIF Ang < One24 - 2 * (j = Four + k) AND Ang > One16 + 2 *
(j = Four + k) THEN
      Ang = ABS(-Ang + 120): IF j <> Four + k THEN Skr = (-Ang +
4) * 10 + Skr ELSE Skr = (-Ang + 6) * 10 + Skr
    ELSEIF Ang < Nty3 AND Ang > Aty7 THEN
      Ang = ABS(-Ang + 90):
      IF j = Fv + k THEN
        Skr = (-Ang / 2 + 2) * 10 + Skr
      ELSEIF j > Fv + k THEN
        NegSkr = (-4 + Ang) * 10 + NegSkr
      END IF
    ELSEIF Ang < Sxt2 - (j = Four + k) AND Ang > Fvt8 + (j = Four
+ k) THEN
      Ang = ABS(-Ang + 60): IF j <> Four + k THEN Skr = (-Ang + 2)
* 10 + Skr ELSE Skr = (-Ang + 3) * 10 + Skr
    END IF
  NEXT:
  FOR j = Drie + k TO 7 + k: P2 = Tryl(i).plt(j):
    Ang = ABS(-ERP(4 + k) + P2): IF Ang > One80 THEN Ang = -Ang +
360
    IF k <> Nul THEN
      IF NegSkr = Nul THEN m = Skr ELSE m = Skr / -NegSkr
```

B' cont'

```
END IF
IF Ang < Twlv - 6 * (j = Drie + k) THEN
 IF MorW = Nul OR j <> Six + k THEN
  IF j = Drie + k THEN Skr = (-Ang + 18) * 10 + Skr ELSE Skr
= (-Ang + 12) * 10 + Skr
 ELSEIF Ang < Ten THEN
  NegSkr = (-9 + Ang) * 10 + NegSkr:
  IF k <> Nul THEN
   IF m < Six THEN
    NegSkr = -40 + NegSkr
   ELSEIF m > Twlv THEN
    NegSkr = NegSkr + 40
   END IF
  END IF
 END IF
ELSEIF Ang < One86 - 3 * (j = Drie + k) + 3 * (j = Six + k)
AND Ang > One74 + 3 * (j = Drie + k) - 3 * (j = Six + k) THEN
 Ang = ABS(-Ang + 180):
 IF j = Drie + k THEN
  Skr = (-Ang + 9) * 10 + Skr
 ELSEIF j = Six + k THEN
  Skr = (-Ang + 3) * 10 + Skr
  IF k <> Nul THEN
   IF m < Four THEN NegSkr = -30 + NegSkr
  END IF
 ELSEIF j = Svn + k THEN
  IF k <> Nul THEN
   IF m < Four THEN NegSkr = (-9 + Ang) * 10 + NegSkr
  END IF
 ELSE
  Skr = (-Ang + 6) * 10 + Skr
 END IF
ELSEIF Ang < One24 - 2 * (j = Drie + k) AND Ang > One16 + 2 *
(j = Drie + k) THEN
 Ang = ABS(-Ang + 120): IF j = Drie + k THEN Skr = (-Ang + 6)
* 10 + Skr ELSE Skr = (-Ang + 4) * 10 + Skr
```

B1 cont

```
ELSEIF Ang < Nty3 AND Ang > Aty7 THEN
  Ang = ABS(-Ang + 90):
  IF j > Fv + k THEN
    NegSkr = (-4 + Ang) * 10 + NegSkr
    IF k <> Nul THEN
      IF m < Fv THEN NegSkr = -40 + NegSkr
    END IF
  ELSEIF j = Fv + k THEN
    Skr = (-Ang / 2 + 2) * 10 + Skr
  END IF
ELSEIF Ang < Sxt2 - (j = Drie + k) AND Ang > Fvt8 + (j = Drie
+ k) THEN
  Ang = ABS(-Ang + 60): IF j = Drie + k THEN Skr = (-Ang + 3)
* 10 + Skr ELSE Skr = (-Ang + 2) * 10 + Skr
END IF
NEXT:
FOR j = Drie + k TO 7 + k: P2 = Tryl(i).plt(j):
  Ang = ABS(-ERP(5) + P2): IF Ang > One80 THEN Ang = -Ang + 360
  IF Ang < Ate - 5 * (j <> Fv + k) THEN
    IF j > Fv + k THEN
      Skr = (-Ang + 14) * 10 + Skr
    ELSEIF j < Fv + k THEN
      Skr = (-Ang + 12) * 10 + Skr
    ELSE
      Skr = (-Ang + 8) * 10 + Skr
    END IF
  ELSEIF Ang < One84 - 2 * (j <> Fv + k) AND Ang > One76 + 2 *
(j <> Fv + k) THEN
    Ang = ABS(-Ang + 180):
    IF j < Fv + k THEN
      Skr = (-Ang + 6) * 10 + Skr
    ELSEIF j = Six + k THEN
      Skr = (-Ang + 5) * 10 + Skr
    ELSEIF j = Svn + k THEN
      Skr = (-Ang + 7) * 10 + Skr
    ELSE
```

B' cont'

```
        Skr = (-Ang + 4) * 10 + Skr
      END IF
    ELSEIF Ang < One23 - (j < Fv + k) - 2 * (j > Fv + k) AND Ang >
One17 + (j < Fv + k) + 2 * (j > Fv + k) THEN
      Ang = ABS(-Ang + 120):
      IF j < Fv + k THEN
        Skr = (-Ang + 4) * 10 + Skr
      ELSEIF j = Six + k THEN
        Skr = (-Ang + 6) * 10 + Skr
      ELSEIF j = Svn + k THEN
        Skr = (-Ang + 5) * 10 + Skr
      ELSE
        Skr = (-Ang + 3) * 10 + Skr
      END IF
    ELSEIF Ang < Nty3 AND Ang > Aty7 THEN
      Ang = ABS(-Ang + 90):
      IF j < Fv + k OR j = Svn + k THEN
        Skr = (-Ang / 2 + 2) * 10 + Skr
      ELSEIF j = Six + k THEN
        IF NegSkr = Nul THEN m = Skr ELSE m = Skr / -NegSkr
        IF m < Six THEN
          NegSkr = (-4 + Ang) * 10 + NegSkr
        ELSEIF m > Twlv THEN
          Skr = (-Ang + 4) * 10 + Skr
        END IF
      END IF
    ELSEIF Ang < Sxt1 - (j < Six + k) AND Ang > Fvt9 + (j < Six +
k) THEN
      Ang = ABS(-Ang + 60):
      IF j < Fv + k THEN
        Skr = (-Ang + 2) * 10 + Skr
      ELSEIF j = Six + k THEN
        Skr = (-Ang + 3) * 10 + Skr
      ELSEIF j = Svn + k THEN
        Skr = (-Ang + 2) * 10 + Skr
      ELSE
```

B1 Cont'

```
        Skr = -Ang + Skr + 10
       END IF
      END IF
     NEXT:
     IF Eind > One16 THEN
      IF Skr < Best \ 3 THEN TmpSort(-Begin + i + 11).Skor = Skr:
GOTO DoNxt'Bailout--can't get enough pts
     END IF
     FOR j = Drie + k TO 7 + k: P2 = Tryl(i).plt(j):
      Ang = ABS(-ERP(6 + k) + P2): IF Ang > One80 THEN Ang = -Ang +
360
      IF NegSkr = Nul THEN m = Skr ELSE m = Skr / -NegSkr
      IF Ang < Ate - 6 * (j = Fv + k) THEN
       IF MorW = One OR j <> Four + k THEN
        IF j = Fv + k THEN
         Skr = (-Ang + 14) * 10 + Skr
        ELSEIF j = Drie + k THEN
         Skr = (-Ang + 8) * 10 + Skr
        ELSEIF j = Four + k THEN
         Skr = (-Ang + 12) * 10 + Skr
        ELSEIF j = Svn + k THEN
         IF m < Fv THEN
          NegSkr = (-8 + Ang) * 10 + NegSkr
         ELSEIF m > Twlv THEN
          NegSkr = (-8 + Ang) * 5 + NegSkr
         END IF
        END IF
       ELSE
        IF m < Six THEN
         NegSkr = (-10 + Ang) * 10 + NegSkr
        ELSEIF m > Twlv THEN
         NegSkr = (-8 + Ang) * 5 + NegSkr
        END IF
       END IF
      ELSEIF Ang < One84 - (j = Fv + k) AND Ang > One76 - (j = Fv +
k) THEN
```

B' Cont

```
Ang = ABS(-Ang + 180):
IF j < Fv + k THEN
  Skr = (-Ang + 3) * 10 + Skr
ELSEIF j = Fv + k THEN
  Skr = (-Ang + 5) * 10 + Skr
ELSE
  NegSkr = (-4 + Ang) * 10 + NegSkr: IF m < Four THEN NegSkr
= -40 + NegSkr
END IF
ELSEIF Ang < One23 - (j < Six + k) AND Ang > One17 + (j < Six
+ k) THEN
Ang = ABS(-Ang + 120):
IF j = Fv + k THEN
  Skr = (-Ang + 6) * 10 + Skr
ELSEIF j < Fv + k THEN
  Skr = (-Ang + 4) * 10 + Skr
ELSE
  Skr = (-Ang + 2) * 10 + Skr
END IF
ELSEIF Ang < Nty3 - (j <> Fv + k) AND Ang > Aty7 + (j <> Fv +
k) THEN
Ang = ABS(-Ang + 90):
IF j < Fv + k THEN
  NegSkr = (-4 + Ang) * 10 + NegSkr: IF m < Fv THEN NegSkr =
-40 + NegSkr
ELSEIF j = Fv + k THEN
  IF m > Twlv THEN Skr = -Ang + 4 + Skr
ELSE
  NegSkr = (-3 + Ang) * 10 + NegSkr: IF m < Fv THEN NegSkr =
-40 + NegSkr
END IF
ELSEIF Ang < Sxt1 - (j < Six + k) AND Ang > Fvt9 + (j < Six +
k) THEN
Ang = ABS(-Ang + 60):
IF j = Fv + k THEN
  Skr = (-Ang + 3) * 10 + Skr
```

B' cont'

```
      ELSEIF j < Fv + k THEN
        Skr = (-Ang + 2) * 10 + Skr
      ELSE
        Skr = Skr + 1
      END IF
    END IF
  NEXT:
  FOR j = Drie + k TO 6 + k: P2 = Tryl(i).plt(j):
    Ang = ABS(-ERP(7 + k) + P2): IF Ang > One80 THEN Ang = -Ang +
360
    IF NegSkr = Nul THEN m = Skr ELSE m = Skr / -NegSkr
    IF Ang < Ate - 6 * (j = Fv) THEN
      IF j = Fv + k THEN
        Skr = (-Ang + 14) * 10 + Skr
      ELSEIF j = Drie + k THEN
        Skr = (-Ang + 8) * 10 + Skr
      ELSEIF j = Four + k THEN
        Skr = (-Ang + 12) * 10 + Skr
      ELSEIF j = Six + k THEN
        IF m < Fv THEN
          NegSkr = (-8 + Ang) * 10 + NegSkr
        ELSEIF m > Twlv THEN
          NegSkr = (-8 + Ang) * 5 + NegSkr
        END IF
      END IF
    ELSEIF Ang < One84 - 3 * (j <> Six + k) AND Ang > One76 + 3 *
(j <> Six + k) THEN
      Ang = ABS(-Ang + 180):
      IF j = Fv + k THEN
        Skr = (-Ang + 7) * 10 + Skr
      ELSEIF j = Drie + k THEN
        IF m < Fv THEN
          NegSkr = (-9 + Ang) * 10 + NegSkr
        ELSEIF m > Twlv THEN
          NegSkr = (-3 + Ang / 2) * 10 + NegSkr
        END IF
```

B' cont'

```
        ELSEIF j = Six + k THEN
          NegSkr = (-3 + Ang) * 10 + NegSkr: IF m < Six THEN NegSkr
= -30 + NegSkr
        END IF
      ELSEIF Ang < One23 - 2 * (j <> Six + k) AND Ang > One17 + 2 *
(j <> Six + k) THEN
        Ang = ABS(-Ang + 120):
        IF j = Fv + k THEN
          Skr = (-Ang + 5) * 10 + Skr
        ELSEIF j < Fv + k THEN
          Skr = (-Ang + 4) * 10 + Skr
        ELSEIF j = Six + k THEN
          Skr = Skr + 1
        END IF
      ELSEIF Ang < Nty3 - (j <> Six + k) AND Ang > Aty7 + (j <> Six
+ k) THEN
        Ang = ABS(-Ang + 90):
        IF j < Fv + k THEN
          NegSkr = (-4 + Ang) * 10 + NegSkr: IF m < Six THEN NegSkr
= -40 + NegSkr
        ELSEIF j = Fv + k THEN
          NegSkr = (-3 + Ang) * 10 + NegSkr: IF m < Four THEN NegSkr
= -30 + NegSkr
        ELSEIF j = Six + k THEN
          NegSkr = (-3 + Ang) * 10 + NegSkr: IF m < Fv THEN NegSkr =
-40 + NegSkr
        END IF
      ELSEIF Ang < Sxt1 - (j < Six + k) AND Ang > Fvt9 + (j < Six +
k) THEN
        Ang = ABS(-Ang + 60): IF j < Six + k THEN Skr = (-Ang + 2) *
10 + Skr ELSE Skr = Skr + 10
      END IF
    NEXT: IF k <> Six THEN k = Six: GOTO DoRA
```

B' cont'

---

CODE FOR COMPATIBILITY

```
DoRAsc: i = One + RA: j = One + RA: GOSUB CalcAsp:
SnCP = INT(CallrP(1 + RA) / 30) + 1: SnPP = INT(PtnrP(1 + RA) / 30) + 1:
IF h = One THEN
 IF SnCP <> SnPP THEN
  Skr = Skr + 30 * HowEx!
 ELSEIF -PtnrP(25) + CallrP(25) > Two THEN
  Skr = Skr + 30 * HowEx!
 ELSE
  MSnC = INT(CallrP(2 + RA) / 30) + 1: MSnP = INT(PtnrP(2 + RA) / 30)
+ 1:
  IF SnCP = One OR SnCP = Fv OR SnCP = Nin THEN
   IF MSnC = Drie OR MSnC = Svn OR MSnC = Elvn OR MSnP = Drie OR MSnP
= Svn OR MSnP = Elvn THEN Skr = Skr + 80 * HowEx!
  ELSEIF SnCP = Two OR SnCP = Six OR SnCP = Ten THEN
   IF MSnC = Four OR MSnC = Ate OR MSnC = Twlv OR MSnP = Four OR MSnP
= Ate OR MSnP = Twlv THEN Skr = Skr + 80 * HowEx!
  ELSEIF SnCP = Drie OR SnCP = Svn OR SnCP = Elvn THEN
   IF MSnC = One OR MSnC = Fv OR MSnC = Nin OR MSnP = One OR MSnP =
Fv OR MSnP = Nin THEN Skr = Skr + 80 * HowEx!
  ELSEIF MSnC = Two OR MSnC = Six OR MSnC = Ten OR MSnP = Two OR
MSnP
= Six OR MSnP = Ten THEN
   Skr = Skr + 80 * HowEx!
  END IF
 END IF
ELSEIF h = Two THEN
 IF ABS(-SnCP + SnPP) = Six THEN
  IF SnCP = Two OR SnCP = Fv OR SnCP = Ate OR SnCP = Elvn THEN NegSkr
= -100 * HowEx! + NegSkr
 END IF
ELSEIF h = Drie THEN
 Skr = Skr + 80 * HowEx!
ELSEIF h = Four THEN
```

B1 Cont

```
 NegSkr = -60 * HowEx! + NegSkr:
 IF ABS(-SnCP + SnPP) = Drie THEN
  IF SnCP = Two OR SnCP = Fv OR SnCP = Ate OR SnCP = Elvn THEN NegSkr
= -100 * HowEx! + NegSkr
 END IF
ELSEIF h = Fv THEN
 IF Qnt = One THEN Skr = Skr + 40 * HowEx! ELSE NegSkr = NegSkr - 40 *
HowEx!
ELSEIF h = Six THEN
 Skr = Skr + 150 * HowEx!
END IF: i = SnCP: j = SnPP: GOSUB SameRlr:
DecCP = INT(CallrP(1 + RA) / 10) + 1: DecPP = INT(PtnrP(1 + RA) / 10) +
1:
IF (DecCP = One OR DecCP = Ate OR DecCP = 15 OR DecCP = 22 OR DecCP = 29
OR DecCP = 36) AND (DecPP = One OR DecPP = Ate OR DecPP = 15 OR DecPP =
22 OR DecPP = 29 OR DecPP = 36) OR (DecCP = Two OR DecCP = Nin OR DecCP
= 16 OR DecCP = 23 OR DecCP = 30 _
) AND (DecPP = Two OR DecPP = Nin OR DecPP = 16 OR DecPP = 23 OR DecPP =
30) OR (DecCP = Drie OR DecCP = Ten OR DecCP = 17 OR DecCP = 24 OR DecCP
= 31) AND (DecPP = Drie OR DecPP = Ten OR DecPP = 17 OR DecPP = 24 OR
DecPP = 31) OR (DecCP = Four OR  _ DecCP = Elvn OR DecCP = 18 OR DecCP =
25 OR DecCP = 32) AND (DecPP = Four OR DecPP = Elvn OR DecPP = 18 OR
DecPP = 25 OR DecPP = 32) THEN
 Skr = Skr + 50
ELSEIF (DecCP = Fv OR DecCP = Twlv OR DecCP = 19 OR DecCP = 26 OR DecCP
= 33) AND (DecPP = Fv OR DecPP = Twlv OR DecPP = 19 OR DecPP = 26 OR
DecPP = 33) OR (DecCP = Six OR DecCP = 13 OR DecCP = 20 OR DecCP = 27 OR
DecCP = 34) AND (DecPP = Six OR  _ DecPP = 13 OR DecPP = 20 OR DecPP =
27 OR DecPP = 34) OR (DecCP = Svn OR DecCP = 14 OR DecCP = 21 OR DecCP =
28 OR DecCP = 35) AND (DecPP = Svn OR DecPP = 14 OR DecPP = 21 OR DecPP
= 28 OR DecPP = 35) THEN
 Skr = Skr + 50
END IF: IF RA = Nul THEN i = SnCP: j = SnPP: GOSUB ScorLink: Sun2Sun = k

IF PtnrP(11 + RA) = True OR CallrP(11 + RA) = True THEN
ELSE
```

B' Cont'

```
x = CallrP(11 + RA): GOSUB Rulr: CAscRlr = Rlr: CAscSn = INT(x / 30) +
1: x = x + 180: IF x > 360 THEN x = -360 + x
 GOSUB Rulr: CDscRlr = Rlr: CDscSn = CAscSn + 6: IF CDscSn > Twlv THEN
CDscSn = -12 + CDscSn
 x = PtnrP(11 + RA): GOSUB Rulr: PAscRlr = Rlr: PAscSn = INT(x / 30) +
1: x = x + 180: IF x > 360 THEN x = -360 + x
 GOSUB Rulr: PDscRlr = Rlr: PDscSn = PAscSn + 6: IF PDscSn > Twlv THEN
PDscSn = -12 + PDscSn
 CARSnInPC = INT(PtnrP(ABS(CAscRlr)) / 30) + 1:
 PARSnInCC = INT(CallrP(ABS(PAscRlr)) / 30) + 1:
 CDRSnInPC = INT(PtnrP(ABS(CDscRlr)) / 30) + 1:
 PDRSnInCC = INT(CallrP(ABS(PDscRlr)) / 30) + 1:
 IF CAscRlr < Nul OR PAscRlr < Nul THEN
  IF CAscRlr < Nul THEN
   x = CAscRlr: GOSUB CoRlrs:
   IF CR1SnInOC = PAscSn OR CR2SnInOC = PAscSn THEN Skr = Skr + 100
   IF CR1SnInOC = CAscSn OR CR1SnInOC = CDscSn OR CR2SnInOC = CAscSn
   OR CR2SnInOC = CDscSn THEN Skr = Skr + 100
  END IF
  IF PAscRlr < Nul THEN
   x = PAscRlr: GOSUB CoRlrs:
   IF PR1SnInOC = CAscSn OR PR2SnInOC = CAscSn THEN Skr = Skr + 100
   IF PR1SnInOC = PAscSn OR PR1SnInOC = PDscSn OR PR2SnInOC = PAscSn
   OR PR2SnInOC = PDscSn THEN Skr = Skr + 100
  END IF
 ELSE
  IF CARSnInPC = PAscSn OR PARSnInCC = CAscSn THEN Skr = Skr + 100
  IF CARSnInPC = CAscSn OR CARSnInPC = CDscSn OR PARSnInCC = PAscSn
OR
  PARSnInCC = PDscSn THEN Skr = Skr + 100
 END IF
 IF CDscRlr < Nul OR PDscRlr < Nul THEN
  IF CDscRlr < Nul THEN
   x = CDscRlr: GOSUB CoRlrs:
   IF CR1SnInOC = PAscSn OR CR2SnInOC = PAscSn THEN Skr = Skr + 100
   IF CR1SnInOC = CAscSn OR CR1SnInOC = CDscSn OR CR2SnInOC = CAscSn
```

B' cont'

```
  OR CR2SnInOC = CDscSn THEN Skr = Skr + 100
 END IF
 IF PDscRlr < Nul THEN
  x = PDscRlr: GOSUB CoRlrs:
  IF PR1SnInOC = CAscSn OR PR2SnInOC = CAscSn THEN Skr = Skr + 100
  IF PR1SnInOC = PAscSn OR PR1SnInOC = PDscSn OR PR2SnInOC = PAscSn
  OR PR2SnInOC = PDscSn THEN Skr = Skr + 100
 END IF
ELSE
 IF CDRSnInPC = PAscSn OR PDRSnInCC = CAscSn THEN Skr = Skr + 100
 IF CDRSnInPC = CAscSn OR CDRSnInPC = CDscSn OR PDRSnInCC = PAscSn
OR
 PDRSnInCC = PDscSn THEN Skr = Skr + 100
END IF:
PARSn = INT(PtnrP(ABS(PAscRlr)) / 30) + 1:
CARSn = INT(CallrP(ABS(CAscRlr)) / 30) + 1:
PDRSn = INT(PtnrP(ABS(PDscRlr)) / 30) + 1:
CDRSn = INT(CallrP(ABS(CDscRlr)) / 30) + 1:
IF CDscRlr < Nul OR PDscRlr < Nul OR CAscRlr < Nul OR PAscRlr < Nul
THEN
 IF CDscRlr < Nul THEN
  IF (PARSn + 6) > Twlv THEN AdjA = -Twlv ELSE AdjA = Nul
  IF (PDRSn + 6) > Twlv THEN AdjD = -Twlv ELSE AdjD = Nul
  x = CDscRlr: GOSUB CoRlrs: CDR1Sn = INT(CallrP(R1) / 30) + 1:
  CDR2Sn = INT(CallrP(R2) / 30) + 1:
  IF CDR1Sn = PDRSn OR CDR2Sn = PDRSn OR CARSn = PARSn THEN Skr =
  Skr + 100
  IF CARSn = (PARSn + 6 + AdjA) OR CDR1Sn = (PDRSn + 6 + AdjD) OR
  CDR2Sn = (PDRSn + 6 + AdjD) THEN Skr = Skr + 100
  IF CARSn = PDRSn OR CDR1Sn = PARSn OR CDR2Sn = PARSn THEN Skr =
  Skr + 100
  IF CARSn = (PARSn + 6 + AdjA) OR CDR1Sn = (PDRSn + 6 + AdjD) OR
  CDR2Sn = (PDRSn + 6 + AdjD) THEN Skr = Skr + 100
 ELSEIF CAscRlr < Nul THEN
  IF (PARSn + 6) > Twlv THEN AdjA = -Twlv ELSE AdjA = Nul
  IF (PDRSn + 6) > Twlv THEN AdjD = -Twlv ELSE AdjD = Nul
```

B' Cont'

```
x = CAscRlr: GOSUB CoRlrs: CAR1Sn = INT(CallrP(R1) / 30) + 1:
CAR2Sn = INT(CallrP(R2) / 30) + 1:
IF CAR1Sn = PARSn OR CAR2Sn = PARSn OR CDRSn = PDRSn THEN Skr =
Skr + 100
IF CDRSn = (PDRSn + 6 + AdjA) OR CAR1Sn = (PARSn + 6 + AdjD) OR
CAR2Sn = (PARSn + 6 + AdjD) THEN Skr = Skr + 100
IF CDRSn = PARSn OR CAR1Sn = PDRSn OR CAR2Sn = PDRSn THEN Skr =
Skr + 100
IF CDRSn = (PDRSn + 6 + AdjA) OR CAR1Sn = (PARSn + 6 + AdjD) OR
CAR2Sn = (PARSn + 6 + AdjD) THEN Skr = Skr + 100
END IF
IF PDscRlr < Nul THEN
 IF (CARSn + 6) > Twlv THEN AdjA = -Twlv ELSE AdjA = Nul
 IF (CDRSn + 6) > Twlv THEN AdjD = -Twlv ELSE AdjD = Nul
 x = PDscRlr: GOSUB CoRlrs: PDR1Sn = INT(PtnrP(R1) / 30) + 1:
 PDR2Sn = INT(PtnrP(R2) / 30) + 1:
 IF PDR1Sn = CDRSn OR PDR2Sn = CDRSn OR PARSn = CARSn THEN Skr =
 Skr + 100
 IF PARSn = (CARSn + 6 + AdjA) OR PDR1Sn = (CDRSn + 6 + AdjD) OR
 PDR2Sn = (CDRSn + 6 + AdjD) THEN Skr = Skr + 100
 IF PARSn = CDRSn OR PDR1Sn = CARSn OR PDR2Sn = CARSn THEN Skr =
 Skr + 100
 IF PARSn = (CARSn + 6 + AdjA) OR PDR1Sn = (CDRSn + 6 + AdjD) OR
 PDR2Sn = (CDRSn + 6 + AdjD) THEN Skr = Skr + 100
ELSEIF PAscRlr < Nul THEN
 IF (CARSn + 6) > Twlv THEN AdjA = -Twlv ELSE AdjA = Nul
 IF (CDRSn + 6) > Twlv THEN AdjD = -Twlv ELSE AdjD = Nul
 x = PAscRlr: GOSUB CoRlrs: PAR1Sn = INT(PtnrP(R1) / 30) + 1:
 PAR2Sn = INT(PtnrP(R2) / 30) + 1:
 IF PAR1Sn = CARSn OR PAR2Sn = CARSn OR PDRSn = CDRSn THEN Skr =
 Skr + 100
 IF PDRSn = (CDRSn + 6 + AdjA) OR PAR1Sn = (CARSn + 6 + AdjD) OR
 PAR2Sn = (CARSn + 6 + AdjD) THEN Skr = Skr + 100
 IF PDRSn = CARSn OR PAR1Sn = CDRSn OR PAR2Sn = CDRSn THEN Skr =
 Skr + 100
 IF PDRSn = (CDRSn + 6 + AdjA) OR PAR1Sn = (CARSn + 6 + AdjD) OR
```

B1 Cont

```
  PAR2Sn = (CARSn + 6 + AdjD) THEN Skr = Skr + 100
 END IF
ELSEIF CARSn = PARSn OR CDRSn = PDRSn THEN
 Skr = Skr + 100
END IF
IF CAscSn = One AND (PAscSn = Ate OR PDscSn = Ate) THEN
 Skr = Skr + 100
ELSEIF CAscSn = Two AND (PAscSn = Svn OR PDscSn = Svn) THEN
 Skr = Skr + 100
ELSEIF CAscSn = Drie AND (PAscSn = Six OR PDscSn = Six) THEN
 Skr = Skr + 100
ELSEIF CAscSn = Nin AND (PAscSn = Twlv OR PDscSn = Twlv) THEN
 Skr = Skr + 100
ELSEIF CAscSn = Ten AND (PAscSn = Elvn OR PDscSn = Elvn) THEN
 Skr = Skr + 100
END IF
IF PAscSn = One AND (CAscSn = Ate OR CDscSn = Ate) THEN
 Skr = Skr + 100
ELSEIF PAscSn = Two AND (CAscSn = Svn OR CDscSn = Svn) THEN
 Skr = Skr + 100
ELSEIF PAscSn = Drie AND (CAscSn = Six OR CDscSn = Six) THEN
 Skr = Skr + 100
ELSEIF PAscSn = Nin AND (CAscSn = Twlv OR CDscSn = Twlv) THEN
 Skr = Skr + 100
ELSEIF PAscSn = Ten AND (CAscSn = Elvn OR CDscSn = Elvn) THEN
 Skr = Skr + 100
END IF: IF CAscSn = PAscSn OR CAscSn = PDscSn THEN Skr = Skr + 100
x = (-1 + SnCP) * 30 + 1: GOSUB Rulr: RCSun = Rlr: x = (-1 + SnPP) *
30 + 1: GOSUB Rulr: RPSun = Rlr:
IF RCSun < Nul OR RPSun < Nul THEN
 IF RCSun < Nul THEN
  IF RCSun = -Fv THEN
   R1 = Ten: R2 = Fv
  ELSEIF RCSun = -Svn THEN
   R1 = Ate: R2 = Svn
  ELSE
```

B' cont

```
    R1 = Nin: R2 = Six
   END IF
   IF INT(CallrP(R1 + RA) / 30) + 1 = SnPP AND INT(PtnrP(RPSun + RA)
   / 30) + 1 = SnCP OR INT(CallrP(R2 + RA) / 30) + 1 = SnPP AND
   INT(PtnrP(RPSun + RA) / 30) + 1 = SnCP THEN Skr = Skr + 100
  END IF
  IF RPSun < Nul THEN
   IF RPSun = -Fv THEN
    R1 = Ten: R2 = Fv
   ELSEIF RPSun = -Svn THEN
    R1 = Ate: R2 = Svn
   ELSE
    R1 = Nin: R2 = Six
   END IF
   IF INT(PtnrP(R1 + RA) / 30) + 1 = SnCP AND INT(CallrP(RCSun + RA)
   / 30) + 1 = SnPP OR INT(PtnrP(R2 + RA) / 30) + 1 = SnCP AND
   INT(CallrP(RCSun + RA) / 30) + 1 = SnPP THEN Skr = Skr + 100
  END IF
 ELSEIF INT(CallrP(RCSun + RA) / 30) + 1 = SnPP AND INT(PtnrP(RPSun +
RA) / 30) + 1 = SnCP THEN
  Skr = Skr + 100
 END IF: i = ABS(CAscRlr): j = ABS(PAscRlr):
ReKalc: GOSUB CalcAsp:
 IF h = One THEN
  Skr = Skr + 100 * HowEx!
 ELSEIF h = Two THEN
  IF i = One OR i = Two OR i = Four OR i = Six AND j = One OR j = Two
OR j = Four OR j = Six THEN
   Skr = Skr + 100 * HowEx!
  END IF
 ELSEIF h = Drie THEN
  Skr = Skr + 100 * HowEx!
 ELSEIF h = Fv THEN
  IF Qnt = One THEN Skr = Skr + 50 * HowEx! ELSE NegSkr = NegSkr - 50
* HowEx!
 ELSEIF h = Six THEN
```

B1 cont

```
  Skr = Skr + 100 * HowEx!
 END IF
 IF i = ABS(CAscRlr) THEN
  i = ABS(CDscRlr): GOTO ReKalc
 ELSEIF j = ABS(PAscRlr) THEN
  j = ABS(PDscRlr): GOTO ReKalc
 END IF: Bad = Nul:
 IF CallrP(26) = One THEN
  i = PtnrP(7 + RA): j = CallrP(11 + RA)
 ELSE
  i = CallrP(7 + RA): j = PtnrP(11 + RA)
 END IF: GOSUB SatHse: NegSkr = 20 * Bad + NegSkr: IF Bad <> Nul THEN
GOSUB Sqr2
 IF CallrP(26) = One THEN i = CallrP(7 + RA): j = PtnrP(11 + RA) ELSE i
= PtnrP(7 + RA): j = CallrP(11 + RA)
 GOSUB SatHse: NegSkr = 10 * Bad + NegSkr: IF Bad <> Nul THEN GOSUB
Sqr2
END IF: i = Twlv + RA:
RevNN: FOR j = One + RA TO 9 + RA: IF DoRevrs THEN SWAP i, j
 GOSUB CalcAsp: IF DoRevrs THEN SWAP i, j
 IF h = One THEN
  Skr = (50 - 30 * (j < Drie OR j = Four)) * HowEx! + Skr
 ELSEIF h = Two THEN
  NegSkr = (-50 + 30 * (j < Drie OR j = Four)) * HowEx! + NegSkr
 END IF
NEXT: IF DoRevrs = Nul THEN DoRevrs = One: GOTO RevNN ELSE DoRevrs = Nul
x = Nty:
DoElmNQual: FOR i = One TO 11:
 IF i = Elvn + RA THEN
  IF CallrP(11 + RA) = True THEN EXIT FOR
 END IF: j = -x * (CallrP(i + RA) \ x) + CallrP(i + RA):
 IF j < 30 THEN
  CF = CF + 1 - 2 * (i < Drie OR i = Elvn) - (i = CAscRlr)
 ELSEIF j < 60 THEN
  CE = CE + 1 - 2 * (i < Drie OR i = Elvn) - (i = CAscRlr)
 ELSEIF j < Nty THEN
```

B1 cont

```
  CA = CA + 1 - 2 * (i < Drie OR i = Elvn) - (i = CAscRlr)
 ELSE
  CW = CW + 1 - 2 * (i < Drie OR i = Elvn) - (i = CAscRlr)
 END IF
NEXT: IF x = Nty THEN CC = CF: CX = CE: CM = CA: CF = Nul: CE = Nul: CA
= Nul: x = 120: GOTO DoElmNQual ELSE x = Nty
DoElmNCQ2: FOR i = One TO 11:
 IF i = Elvn THEN
  IF PtnrP(11 + RA) = True THEN EXIT FOR
 END IF: j = -x * (PtnrP(i + RA) \ x) + PtnrP(i + RA):
 IF j < 30 THEN
  PF = PF + 1 - 2 * (i < Drie OR i = Elvn) - (i = PAscRlr)
 ELSEIF j < 60 THEN
  PE = PE + 1 - 2 * (i < Drie OR i = Elvn) - (i = PAscRlr)
 ELSEIF j < Nty THEN
  PA = PA + 1 - 2 * (i < Drie OR i = Elvn) - (i = PAscRlr)
 ELSE
  PW = PW + 1 - 2 * (i < Drie OR i = Elvn) - (i = PAscRlr)
 END IF
NEXT: IF x = Nty THEN PC = PF: PX = PE: PM = PA: PF = Nul: PE = Nul: PA
= Nul: x = 120: GOTO DoElmNCQ2
REDIM Temp(1 TO 4):
IF (CF = CE AND CF = CW) OR (CF = CE AND CF = CA) OR (CF = CA AND CF =
CW) OR (CA = CE AND CA = CW) THEN
 CBalElem = True
END IF: Temp(1) = CF: Temp(2) = CE: Temp(3) = CA: Temp(4) = CW:
CE1 = IMaxI(SEG Temp(1), 4) + 1: Temp(CE1) = Nul:
CE2 = IMaxI(SEG Temp(1), 4) + 1: Temp(CE2) = Nul:
CE3 = IMaxI(SEG Temp(1), 4) + 1: Temp(CE3) = Nul:
CE4 = IMaxI(SEG Temp(1), 4) + 1:
IF (PF = PE AND PF = PW) OR (PF = PE AND PF = PA) OR (PF = PA AND PF =
PW) OR (PA = PE AND PA = PW) THEN
 PBalElem = True
END IF: Temp(1) = PF: Temp(2) = PE: Temp(3) = PA: Temp(4) = PW:
PE1 = IMaxI(SEG Temp(1), 4) + 1: Temp(PE1) = Nul:
PE2 = IMaxI(SEG Temp(1), 4) + 1: Temp(PE2) = Nul:
```

B' cont'

```
PE3 = IMaxI(SEG Temp(1), 4) + 1: Temp(PE3) = Nul:
PE4 = IMaxI(SEG Temp(1), 4) + 1: REDIM Temp(1 TO 3):
IF (CC = CX AND CC = CM) THEN CBalMod = True: GOTO PMode
Temp(1) = CC: Temp(2) = CX: Temp(3) = CM: CQ1 = IMaxI(SEG Temp(1), 3) +
1: Temp(CQ1) = Nul:
CQ2 = IMaxI(SEG Temp(1), 3) + 1: Temp(CQ2) = Nul:
CQ3 = IMaxI(SEG Temp(1), 3) + 1:
PMode: IF (PC = PX AND PC = PM) THEN PBalMod = True: GOTO DunMod
Temp(1) = PC: Temp(2) = PX: Temp(3) = PM: PQ1 = IMaxI(SEG Temp(1), 3) +
1: Temp(PQ1) = Nul:
PQ2 = IMaxI(SEG Temp(1), 3) + 1: Temp(PQ2) = Nul:
PQ3 = IMaxI(SEG Temp(1), 3) + 1:
DunMod: NoRepeat = Nul: ERASE Temp:
IF CBalElem OR PBalElem THEN
ELSEIF (CE1 = One OR CE2 = One) AND PE1 = Drie THEN
 Skr = Skr + 50
ELSEIF (CE1 = Two OR CE2 = Two) AND PE1 = Four THEN
 Skr = Skr + 50
ELSEIF (CE1 = Drie OR CE2 = Drie) AND PE1 = One THEN
 Skr = Skr + 50
ELSEIF (CE1 = Four OR CE2 = Four) AND PE1 = Two THEN
 Skr = Skr + 50
ELSE
 IF CBalMod OR PBalMod THEN
 ELSEIF CQ1 = Two AND PQ1 = Two THEN
  NegSkr = -10 + NegSkr: NoRepeat = True
 ELSEIF CQ1 = Two OR PQ1 = Two THEN
  IF CE1 <> Drie AND PE1 <> Drie THEN NegSkr = -50 + NegSkr: NoRepeat
= True
 END IF
END IF
IF CBalElem OR PBalElem THEN
ELSEIF (CE1 = One OR CE2 = One) AND PE2 = Drie THEN
 Skr = Skr + 50
ELSEIF (CE1 = Two OR CE2 = Two) AND PE2 = Four THEN
 Skr = Skr + 50
```

B' cont'

```
ELSEIF (CE1 = Drie OR CE2 = Drie) AND PE2 = One THEN
 Skr = Skr + 50
ELSEIF (CE1 = Four OR CE2 = Four) AND PE2 = Two THEN
 Skr = Skr + 50
ELSE
 IF NoRepeat = True THEN
 ELSEIF CBalMod OR PBalMod THEN
 ELSEIF CQ1 = Two AND PQ1 = Two THEN
  NegSkr = -80 + NegSkr
 ELSEIF CQ1 = Two OR PQ1 = Two THEN
  IF CE1 <> Drie AND PE1 <> Drie THEN NegSkr = -40 + NegSkr
 END IF
END IF
IF CE3 = PE1 OR CE4 = PE1 OR CE3 = PE2 OR CE4 = PE2 THEN
 Skr = Skr + 50
 IF PBalElem THEN
 ELSEIF CBalElem AND (CE4 = PE1 OR CE4 = PE2) THEN
  Skr = Skr + 50
 END IF
END IF
IF PE3 = CE1 OR PE4 = CE1 OR PE3 = CE2 OR PE4 = CE2 THEN
 Skr = Skr + 50
 IF CBalElem THEN
 ELSEIF PBalElem AND (PE4 = CE1 OR PE4 = CE2) THEN
  Skr = Skr + 50
 END IF
END IF
IF CBalMod OR PBalMod THEN
ELSE
 IF CQ1 = One AND (PQ1 = Two OR PQ1 = Drie) THEN
  Skr = Skr + 50
 ELSEIF CQ1 = Two AND (PQ1 = One OR PQ1 = Drie) THEN
  Skr = Skr + 50
 ELSEIF CQ1 = Drie AND (PQ1 = One OR PQ1 = Two) THEN
  Skr = Skr + 50
 ELSEIF CQ1 = One AND PQ1 = One THEN
```

B' cont'

```
  NegSkr = -50 + NegSkr
 ELSEIF CQ1 = Two AND PQ1 = Two THEN
  NegSkr = -50 + NegSkr
 END IF
END IF
C = Twlv: O = Drie: T = Four: R = Drie: E = Two: NoHelp = Nul: i = Two +
RA: j = Drie + RA:
MoonMer: AspGorB = True: GOSUB CalcAsp: IF h > Nul THEN GOSUB ScorHarm
IF h = Nul OR h = Four OR (h = Fv AND Qnt = True) THEN NoHelp = NoHelp +
1
IF DoRevrs = Nul THEN DoRevrs = One: SWAP i, j: GOTO MoonMer ELSE
DoRevrs = Nul
C = Ten: T = Drie: R = Six: j = Drie + RA: GOSUB CalcAsp: IF h > Nul
THEN GOSUB ScorHarm:
IF h = Four THEN
 IF NoHelp = Two THEN
  i = Drie + RA: j = One + RA: GOSUB CalcAsp:
  IF h = Nul OR h = Four THEN
   i = One + RA: j = Drie + RA: GOSUB CalcAsp:
   IF h = Nul OR h = Four THEN NegSkr = -100 + NegSkr
  END IF
 END IF
END IF: i = Two + RA: j = Six + RA: O = Two: R = Drie: AspGorB = One:
MoonJup: GOSUB CalcAsp: IF h > Nul THEN GOSUB ScorHarm
IF DoRevrs = Nul THEN DoRevrs = One: SWAP i, j: GOTO MoonJup ELSE
DoRevrs = Nul
C = Ate: i = Drie + RA: j = Six + RA:
MerJup: GOSUB CalcAsp: IF h > Nul THEN GOSUB ScorHarm
IF DoRevrs = Nul THEN DoRevrs = One: SWAP i, j: GOTO MerJup ELSE DoRevrs
= Nul
C = Twlv: O = Six: T = Four: i = One + RA:
RevSun: FOR j = Drie + RA TO 10 + RA: IF j = Four + RA THEN j = Six + RA
 IF j = Ate + RA THEN j = Nin + RA
 IF O = Drie THEN O = Six: R = Drie
 IF j = Six + RA THEN O = Drie: R = Two
 IF DoRevrs THEN SWAP i, j
```

B1 cont

```
GOSUB CalcAsp: IF DoRevrs THEN SWAP i, j
IF h > Nul THEN
  IF Skr / (-NegSkr - (NegSkr = Nul)) < Two THEN AspGorB = One ELSE
AspGorB = True
  GOSUB ScorHarm:
  IF j > Six + RA THEN
    IF h = One AND AspGorB = One THEN Skr = -C * HowEx! * 20 + Skr:
NegSkr = NegSkr - C * HowEx! * 10
  END IF
 END IF
NEXT: IF DoRevrs THEN DoRevrs = Nul ELSE DoRevrs = One: GOTO RevSun
IF PtnrP(11 + RA) <> True THEN
 GOSUB CalcAsp: IF h = Four OR h = Fv THEN GOSUB ScorHarm2
END IF: SWAP i, j:
IF CallrP(11 + RA) <> True THEN
 GOSUB CalcAsp: IF h = Four OR h = Fv THEN GOSUB ScorHarm2
END IF: i = Two + RA:
RevMoon: FOR j = Two + RA + DoRevrs TO 10 + RA: IF j = Drie + RA THEN j
= Svn + RA
 IF j = Ate + RA THEN j = Nin + RA
 IF DoRevrs THEN SWAP i, j
 GOSUB CalcAsp:
 IF h > Nul THEN
  IF Skr / (-NegSkr - (NegSkr = Nul)) < Two THEN AspGorB = One ELSE
AspGorB = True
  GOSUB ScorHarm: IF h = One AND AspGorB = One THEN Skr = -C * HowEx!
* 20 + Skr: NegSkr = NegSkr - C * HowEx! * 10
 END IF: IF DoRevrs THEN SWAP i, j
NEXT: IF DoRevrs THEN DoRevrs = Nul ELSE DoRevrs = One: GOTO RevMoon
IF PtnrP(11 + RA) <> True THEN
 GOSUB CalcAsp: IF h = Four OR h = Fv THEN GOSUB ScorHarm2
END IF: SWAP i, j:
IF CallrP(11 + RA) <> True THEN
 GOSUB CalcAsp: IF h = Four OR h = Fv THEN GOSUB ScorHarm2
END IF: C = Ate: O = Two: T = Drie: R = Two: E = One: i = Drie + RA:
RevMer: FOR j = Four + RA TO 11 + RA: IF j = Six + RA THEN j = Svn + RA
```

```
IF j = Elvn + RA THEN
  IF DoRevrs THEN
    IF CallrP(11 + RA) = True THEN EXIT FOR
  ELSEIF PtnrP(11 + RA) = True THEN
    EXIT FOR
  END IF
 END IF: IF DoRevrs THEN SWAP i, j: IF i = Four THEN O = Two
 GOSUB CalcAsp: IF h > Nul THEN AspGorB = One: GOSUB ScorHarm
 IF O = Two THEN O = Four
 IF DoRevrs THEN SWAP i, j
NEXT: IF DoRevrs THEN DoRevrs = Nul ELSE DoRevrs = One: GOTO RevMer
O = -Drie: R = Nul: i = Four + RA:
RevVen: FOR j = Six + RA TO 10 + RA: IF j = Ate + RA THEN j = Nin + RA
  IF DoRevrs THEN SWAP i, j: IF i = Six THEN O = -Drie: R = Nul
  GOSUB CalcAsp: IF h > Nul THEN AspGorB = One: GOSUB ScorHarm
  IF O = -Drie THEN O = Four: R = Two
  IF DoRevrs THEN SWAP i, j
NEXT: IF DoRevrs THEN DoRevrs = Nul ELSE DoRevrs = One: GOTO RevVen
IF PtnrP(11 + RA) <> True THEN
  GOSUB CalcAsp: IF h = Four OR h = Fv THEN GOSUB ScorHarm2
END IF: SWAP i, j:
IF CallrP(11 + RA) <> True THEN
  GOSUB CalcAsp: IF h = Four OR h = Fv THEN GOSUB ScorHarm2
END IF: i = Fv + RA: j = Fv + RA: GOSUB CalcAsp:
IF h = One THEN
  IF Skr / (-NegSkr - (NegSkr = Nul)) < Two THEN AspGorB = One ELSE
AspGorB = True
ELSEIF h = Fv THEN
  IF Qnt = One THEN Skr = Skr + 20 * HowEx! ELSE NegSkr = NegSkr - 20 *
HowEx!
END IF
RevMars: FOR j = Six + RA TO 10 + RA: IF j = Ate + RA THEN j = Nin + RA
  IF DoRevrs THEN SWAP i, j
  GOSUB CalcAsp: IF DoRevrs THEN SWAP i, j
  IF h > Nul THEN
    AspGorB = One: GOSUB ScorHarm
```

B' cont'

```
  IF j > Six + RA THEN
   IF h = 1 THEN
    IF Skr / (-NegSkr - (NegSkr = Nul)) < Two THEN AspGorB = One
ELSE AspGorB = True
   END IF
  END IF
 END IF
NEXT: IF DoRevrs THEN DoRevrs = Nul ELSE DoRevrs = One: GOTO RevMars
IF PtnrP(11 + RA) <> True THEN
 GOSUB CalcAsp: IF h = Four OR h = Fv THEN GOSUB ScorHarm2
END IF: SWAP i, j:
IF CallrP(11 + RA) <> True THEN
 GOSUB CalcAsp: IF h = Four OR h = Fv THEN GOSUB ScorHarm2
END IF: i = Six + RA:
RevJup: FOR j = Six + RA + DoRevrs TO 11 + RA:
 IF j = Elvn + RA THEN
  IF DoRevrs THEN
   IF CallrP(11 + RA) = True THEN EXIT FOR
  ELSEIF PtnrP(11 + RA) = True THEN
   EXIT FOR
  END IF
 END IF: IF DoRevrs THEN SWAP i, j
 GOSUB CalcAsp: IF DoRevrs THEN SWAP i, j
 IF h > Nul THEN
  IF j = Six + RA THEN
   IF Skr / (-NegSkr - (NegSkr = Nul)) < Two THEN AspGorB = One ELSE
AspGorB = True
  ELSEIF j = Elvn + RA THEN
   AspGorB = True
  ELSE
   AspGorB = One
  END IF: GOSUB ScorHarm:
 END IF
NEXT: IF DoRevrs THEN DoRevrs = Nul ELSE DoRevrs = One: GOTO RevJup
i = Svn + RA:
RevSat: FOR j = Svn + RA + DoRevrs TO 11 + RA:
```

B1 cont'

```
IF j = Elvn + RA THEN
 IF DoRevrs THEN
  IF CallrP(11 + RA) = True THEN EXIT FOR
 ELSEIF PtnrP(11 + RA) = True THEN
  EXIT FOR
 END IF
END IF: IF DoRevrs THEN SWAP i, j
GOSUB CalcAsp: IF j = Elvn + RA THEN SatSn = INT(CallrP(7) / 30) + 1
IF DoRevrs THEN SWAP i, j: IF j = Elvn + RA THEN SatSn = INT(PtnrP(7)
/ 30) + 1
IF h > Nul THEN
 AspGorB = One: GOSUB ScorHarm:
 IF h = One THEN
  IF j = Elvn + RA AND (SatSn = One OR SatSn = Four OR SatSn = Fv)
THEN
   Skr = Skr - C * HowEx! * 20: NegSkr = NegSkr - 12 * HowEx! * 10
  ELSEIF j <> Nin + RA AND Skr / (-NegSkr - (NegSkr = Nul)) < Two
THEN
   Skr = Skr - C * HowEx! * 20: NegSkr = NegSkr - C * HowEx! * 10
  END IF
 END IF
END IF
NEXT: IF DoRevrs THEN DoRevrs = Nul ELSE DoRevrs = One: GOTO RevSat
IF PtnrP(11 + RA) <> True THEN
 AspGorB = One: j = Elvn + RA:
 FOR i = Ate + RA TO 10 + RA: GOSUB CalcAsp: IF h > Nul THEN GOSUB
 ScorHarm
 NEXT
END IF
IF CallrP(11 + RA) <> True THEN
 AspGorB = One: j = Elvn + RA:
 FOR i = Ate + RA TO 10 + RA: GOSUB CalcAsp: IF h > Nul THEN GOSUB
 ScorHarm
 NEXT
END IF: IF RA = Nul THEN RA = Twlv: GOTO DoRAsc
```

B1 Cont.

What is claimed is:

1. Astrological entertainment method of evaluating a degree of astrological attractiveness between a requesting player and one of a plurality of subject players, comprising:

a) storing sets of information corresponding respectively with astrological profiles of the plurality of subject players, each of the sets of information including personal information regarding one of the plurality of subject players;

b) inputting a set of information corresponding to an astrological profile of the requesting player to a processing apparatus via a telecommunications system, with the astrological profile of the requesting player including birth data of the requesting player, wherein said inputting includes inputting a number, with the telecommunications system, to designate a place of birth for the birth data of the astrological profile of the requesting player and the number corresponds to a selected one of a zip code and a telephone area code;

c) electronically comparing the set of information corresponding with the requesting player to one of the sets of information of the plurality of subject players for determining the degree of astrological attractiveness between the requesting player and the one of the subject players; and d) if the degree of astrological compatability between the requesting player and the one of the subject players exceeds a preselected threshold, transmitting the personal information of the one of the subject players to the requesting player.

2. The method of claim 1, wherein said b) includes providing the set of information corresponding to an astrological profile of the requesting player by way of a rasterizing apparatus.

3. Astrological entertainment method of evaluating a degree of astrological attractiveness between a requesting player and one of a plurality of subject players, comprising:

a) storing sets of information corresponding respectively with astrological profiles of the plurality of subject players, each of the sets of information including personal information regarding one of the plurality of subject players;

b) providing a set of information corresponding to an astrological profile of the requesting player;

c) electronically comparing the set of information corresponding with the requesting player to one of the sets of information of the plurality of subject players for determining the degree of astrological attractiveness between the requesting player and the one of the subject players; and d) if the degree of astrological compatability between the requesting player and the one of the subject players exceeds a preselected threshold, transmitting the personal information of the one of the subject players to the requesting player, wherein the preselected threshold is exceeded and said d) includes, 1) electronically indicating, to the first one of the subject players that the requesting player desires to communicate with him/her, and 2) electronically linking the requesting player with the first one of the subject players, by way of a communication link, when the first one of the subject players approves, in advance, of the electronic linking.

4. Astrological entertainment method of evaluating a degree of astrological attractiveness between a requesting player and one of a plurality of subject players, comprising:

a) storing sets of information corresponding respectively with astrological profiles of the plurality of subject players each of the sets of information including personal information regarding one of the plurality of subject players;

b) providing a set of information corresponding to an astrological profile of the requesting player;

c) electronically comparing the set of information corresponding with the requesting player to one of the sets of information of the plurality of subject players for determining the degree of astrological attractiveness between the requesting player and the one of the subject players wherein the astrological profiles of the subject players are stored sequentially in a database and said c) comprises, 1) accessing the database and selecting a first one of the astrological profiles, 2) correlating the set of information representative of the requesting player with a currently selected set of information representative of the first one of the astrological profiles, 3) based on the correlating of said 2), generating a score, 4) buffering the score generated in said 3), 5) accessing the database and selecting a next one of the astrological profiles, and 6) repeating said 2)–5) for a selected number of astrological profiles stored in the database; and d) if the degree of astrological compatability between the requesting player and the one of the subject players exceeds a preselected threshold, transmitting the personal information of the one of the subject players to the requesting player.

5. The method of claim 4, in which the degree of astrological compatibility varies directly as a function of the score and the preselected threshold corresponds to a reference score, wherein said d) includes transmitting any buffered score that exceeds the reference score.

6. The method of claim 4, wherein said 2) includes correlating the sets of information by reference to a preselected, set of astrological data varying as a function of either an ecliptic position of astronomic bodies, a right ascension of the astronomic bodies or a position of the astronomic bodies.

7. Astrological entertainment method for evaluating a degree of astrological compatibility between a first player and a second player, comprising:

a) storing a set of information corresponding with an astrological profile of the first player;

b) providing a set of information corresponding with an astrological profile of the second player;

c) electronically comparing the set of information corresponding with the astrological profile of the first player to the set of information corresponding with the astrological profile of the second player to obtain an astrological compatibility score;

d) normalizing the astrological compatibility score on the basis of a reference score, the reference score being based on a score received by two players having an ideal predetermined astrological relationship;

e) transmitting the astrological compatibility score, normalized in accordance with said d), to at least one of the first and second players for providing a reflection of the degree to which the first and players are astrologically compatibles;

f) providing a library of prerecorded messages, each message being mapped to an associated score and including information deemed suitable for two players receiving the associated score;

g) electronically corresponding the astrological compatibility score, normalized in accordance with said d), with one of the scores provided in said f) to obtain one of the prerecored messages; and h) transmitting the prerecored message obtained in said g) to the at least one of the first and second players of said e).

8. Astrological entertainment method of evaluating a degree of astrological compatibility between a first player and a second player, comprising:

a) storing a set of information corresponding with an astrological profile of the first player;

b) inputting a set of information corresponding to an astrological profile of the second player by way of a telecommunications device, wherein the astrological profile of the second player includes birth data of the second player and said inputting includes inputting a number, with the telephone, to designate a place of birth for the birth data of the astrological profile of the second player and the number corresponds to a selected one of a zip code and a telephone area code;

c) electronically comparing the set of information corresponding with the astrological profile of the first player to the set of information corresponding with the astrological profile of the second player to obtain an astrological compatibility score;

d) normalizing the astrological compatibility score on the basis of a reference score, the reference score being based on a score received by two players having an ideal predetermined astrological relationship; and e) transmitting the astrological compatibility score, normalized in accordance with said d), to at least one of the first and second players for providing a reflection of the degree to which the first and players are astrologically compatible.

9. The method of claim 7, wherein said b) includes providing the set of information corresponding to an astrological profile of the second player by way of a rasterizing apparatus.

10. Astrological entertainment method of evaluating a degree of astrological compatibility between a first player and a second player, comprising:

a) storing a set of information corresponding with an astrological profile of the first player;

b) providing a set of information corresponding with an astrological profile of the second player;

c) electronically comparing the set of information corresponding with the astrological profile of the first player to the set of information corresponding with the astrological profile of the second player to obtain an astrological compatibility score, wherein said c) includes controlling said comparing by reference to a preselected set of astrological data varying as a function of either an ecliptic position of astronomic bodies, a right ascension of the astronomic bodies or a position of the astronomic bodies;

d) normalizing the astrological compatibility score on the basis of a reference score, the reference score being based on a score received by two players having an ideal predetermined astrological relationship; and e) transmitting the astrological compatibility score, normalized in accordance with said d), to at least one of the first and second players for providing a reflection of the degree to which the first and players are astrologically compatible.

11. The method of claim 3, wherein said b) includes inputting the set of information corresponding to an astrological profile of the second player by way of a rasterizing apparatus.

12. The method of claim 8, wherein said b) includes providing the set of information corresponding to an astrological profile of the second player by way of a rasterizing apparatus.

* * * * *